US007326027B1

(12) United States Patent
Skoch et al.

(10) Patent No.: US 7,326,027 B1
(45) Date of Patent: Feb. 5, 2008

(54) DEVICES AND METHODS OF OPERATION THEREOF FOR PROVIDING STABLE FLOW FOR CENTRIFUGAL COMPRESSORS

(75) Inventors: Gary J. Skoch, Chardon, OH (US); Mark A. Stevens, Broadview Heights, OH (US); Thomas A. Jett, Olmsted Falls, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 334 days.

(21) Appl. No.: 10/856,361

(22) Filed: May 25, 2004

(51) Int. Cl.
*F01D 17/08* (2006.01)

(52) U.S. Cl. ..... 415/17; 415/48; 415/49; 415/150; 415/208.3

(58) Field of Classification Search ..... 415/1, 415/17, 26, 27, 48, 49, 119, 148, 150, 208.2, 415/208.3, 208.4
See application file for complete search history.

(56) References Cited

U.S. PATENT DOCUMENTS

| | | | | |
|---|---|---|---|---|
| 3,957,392 | A | 5/1976 | Blackburn | |
| 3,976,390 | A | 8/1976 | Silvern et al. | |
| 4,029,430 | A | 6/1977 | Fonda-Bonardi | |
| 4,378,194 | A | 3/1983 | Bandukwalla | |
| 4,421,457 | A | 12/1983 | Yoshinaga et al. | |
| 4,533,293 | A | 8/1985 | Hendriks | |
| 4,743,161 | A | 5/1988 | Fisher et al. | |
| 4,921,079 | A | 5/1990 | Vogelsang | |
| 4,966,523 | A | 10/1990 | Sherikar | |
| 4,969,798 | A * | 11/1990 | Sakai et al. | 415/157 |
| 5,145,317 | A | 9/1992 | Brasz | |
| 5,236,301 | A | 8/1993 | Palmer | |
| 5,437,539 | A | 8/1995 | Gysling et al. | |
| 5,605,435 | A | 2/1997 | Haugen | |
| 5,683,223 | A * | 11/1997 | Harada et al. | 415/17 |
| 6,537,028 | B1 * | 3/2003 | Izumi et al. | 415/208.3 |
| 6,540,481 | B2 | 4/2003 | Moussa et al. | |
| 6,547,520 | B2 | 4/2003 | Zinsmeyer et al. | |
| 6,554,567 | B2 | 4/2003 | Sishtla | |

(Continued)

FOREIGN PATENT DOCUMENTS

JP 54-133613 A * 10/1979

(Continued)

OTHER PUBLICATIONS

Skoch, G.J., 2003, "Experimental Investigation of Centrifugal Compressor Stabilization Techniques," ASME Turbo Expo, Jun. 16-19, 2003 Atlanta, Georgia, NASA/TM—2003-212599.

(Continued)

*Primary Examiner*—Edward K. Look
*Assistant Examiner*—Nathan Wiehe
(74) *Attorney, Agent, or Firm*—Gary Borda; Robert Rotella

(57) ABSTRACT

Centrifugal compressor flow stabilizing devices and methods of operation thereof are disclosed that act upon the flow field discharging from the impeller of a centrifugal compressor and modify the flow field ahead of the diffuser vanes such that flow conditions contributing to rotating stall and surge are reduced or even eliminated. In some embodiments, shaped rods and methods of operation thereof are disclosed, whereas in other embodiments reverse-tangent air injection devices and methods are disclosed.

20 Claims, 15 Drawing Sheets

U.S. PATENT DOCUMENTS

| | | | | |
|---|---|---|---|---|
| 6,857,845 | B2 * | 2/2005 | Stabley et al. | 415/1 |
| 2003/0210980 | A1 | 11/2003 | Lawlor et al. | |
| 2004/0009061 | A1 | 1/2004 | McDonald | |

FOREIGN PATENT DOCUMENTS

| | | | | |
|---|---|---|---|---|
| JP | 56-9696 | A | * | 1/1981 |
| JP | 60-132099 | A | * | 7/1985 |

OTHER PUBLICATIONS

Rodgers, C., 1982, "The Performance of Centrifugal Compressor Channel Diffusers," ASME. Paper No. 82-GT-10.

Spakovszky, Z.S., 2002, "Backward Traveling Rotating Stall Waves in Centrifugal Compressors," ASME Turbo Expo, Amsterdam, The Netherlands, ASME Paper No. GT-2002-2039.

* cited by examiner

ACTIVATED POSITION

ELECTRIC SUPPLY
FLUID SUPPLY
STALL/SURGE DETECTION
FLOW STABILIZING DEVICE CONTROLLER
10
12
14
16
20
22A
24
24A
26,28,30
36
40
58
62
64
66
68
70
74
76
78
80
82
84
86
88
90
96
98
100
102
104
106
106A
107
108
110

RETRACTED POSITION

STALL/SURGE DETECTION
FLUID SUPPLY
ELECTRIC SUPPLY
FLOW STABILIZING DEVICE CONTROLLER
10
12
14
16
20
22A
24
24A
26,28,30
36
40
58
62
64
66
68
70
74
76
78
80
82
84
86
88
90
96
98
100
102
104
106
106A
107
108
110

DEVICES AND METHODS OF OPERATION THEREOF FOR PROVIDING STABLE FLOW FOR CENTRIFUGAL COMPRESSORS

ORIGIN OF THE INVENTION

The invention described herein was made by employees of the United States Government and may be used by or for the Government for governmental purposes without payment of any royalties thereon or therefor.

FIELD OF THE INVENTION

The present invention relates to centrifugal compressors and, more particularly, to devices and methods of operation thereof that reduce the threat of flow instabilities, commonly known as rotating stall and surge conditions, that can develop in centrifugal compressors used in turbine engines and industrial processes.

BACKGROUND OF THE INVENTION

The objective of a centrifugal compressor is to collect a steadily flowing stream of gas, pressurize the stream, and provide a steady pressurized stream to a subsequent process or device used in turbine engines and industrial processes. Instability can develop within the fluid being processed by a centrifugal compressor that interrupts the steady flow of fluid through the compressor. The instability can range in magnitude from weak to severe. Instabilities are commonly referred to as rotating stall and surge, or simply stall and surge conditions, where rotating stall is generally at the weak end of the scale and surge describes the severe condition. In a surging condition, flow direction through the centrifugal compressor can oscillate rapidly between the forward and reverse. Local oscillations of pressure disadvantageously occur within the compressor and adjacent components. Time-averaged supplies of pressure and flow to downstream processes are undesirably diminished. More particularly, catastrophic damage to the centrifugal compressor and adjacent components can result from pressure and flow oscillations. Further, downstream processes are disrupted with potentially serious consequences. In the case of a turbine engine, the production of thrust or shaft-horsepower is severely reduced or stopped altogether.

The flow-field instability leading to surge can develop in either the impeller or diffuser of the compressor, with diffuser initiated surge being the more severe case. There are various theories regarding the fundamental causes of surge that have been, shown to have merit through experimentation. The variety of substantiated theory suggests that many factors contribute to the development of surge. The factor that becomes the primary contributor to surge development varies with operating condition, compressor geometry and flow conditions at the inlet and discharge of the compressor. As such, it is difficult to prescribe a single solution.

There is little prior art to address the problem of controlling stall and surge in centrifugal compressors. Prior art for controlling these problems that does exist falls into five categories: 1) openings that are drilled between diffuser passages to permit communication between individual passages of the diffuser; 2) variable diffuser vane geometry or variable inlet guide vanes located upstream of the impeller that change matching between the impeller and diffuser or the operating characteristic of the stage; 3) devices that vary the pressure, temperature or flow conditions downstream of the compressor stage; 4) pulsed and steady injection of air in the general direction of diffuser flow at various locations on the diffuser vanes or diffuser passage endwalls; and 5) pulsed and steady injection of air into the impeller blades in the general direction of inlet flow from an upstream location.

A drilled opening between diffuser passages operates continuously over the entire operating characteristic of the compressor even though its contribution to stability is only required at one point. Hence, losses produced by this technique must be endured when stability enhancement is not required.

Variable geometry of diffusers is expensive to implement, as it requires numerous complex parts. Further, it disadvantageously activates slowly compared to the onset of stall and surge.

Downstream devices reduce pressure by bleeding process flow or by controlling a downstream device. The response of the compressor to a downstream control action is slow compared to control actions that act closer to the source of the instability. Bleeding process flow reduces process efficiency since work that has gone into pressurizing the flow is disadvantageously lost with the bleed-flow.

Injecting air into the diffuser or upstream of the impeller, related to categories 4 and 5, in the general direction of compressor through-flow has been shown to improve stability in certain cases when an external air source is used to supply injectors. The results are less significant when air from within the compressor flow path is used. Piping to deliver air at the injection points disadvantageously adds weight and complexity to an engine. As such, air injection techniques may be limited to ground based centrifugal compression systems, thereby reducing the possible commercial applications thereof. It is desired to provide devices and method of operation thereto for maintaining stable operation of centrifugal compressors by preventing stall and surge conditions therein and to do so without suffering the drawbacks of the prior art techniques.

OBJECTS OF THE INVENTION

It is a primary objective of the invention to provide devices and methods of operation thereof that can be employed for the purpose of maintaining stable operation of a centrifugal compressor by preventing stall and surge conditions therein.

It is a further objective of the invention to bring about a return to stable operation in a centrifugal compressor wherein stall or surge conditions have already commenced.

It is an additional objective of the invention to provide a device that can be activated remotely when compression system instability or instability precursors are detected.

It is an additional object of the invention to provide a device that can also be employed in a stationary configuration.

SUMMARY OF THE INVENTION

The invention is directed to devices and methods of operation thereof for controlling the flow within a diffuser of a compressor so as to prevent or eliminate flow instabilities of the compressor that might otherwise cause rotating stall and surge conditions in the compressor itself.

A centrifugal compressor comprises an impeller that rotates inside a stationary flow path that is typically formed by an inlet, a shroud, a diffuser and a discharge duct. The impeller is comprised of a plurality of blades attached to a hub that is rotated by a shaft and is contained within a stationary shroud. The impeller receives an input fluid and imparting kinetic energy to the received fluid provides an output thereof in an orthogonal direction relative to the axis of rotation. The output of the impeller is received by a diffuser having blades or vanes contained within hub and shroud end-walls wherein kinetic energy contained within the received fluid is recovered providing an increase in static pressure of the received fluid. At least one flow stabilizing device is inserted into the diffuser for the purpose of maintaining or restoring compressor stability.

In mechanical embodiments, the methods of invention provide a stabilizing device employing a single shaped rod or plurality of shaped rods that are made to interact in a continuous or intermittent fashion with flow in the region of the diffuser that is near the impeller discharge. Each of the flow stabilizing devices is rendered operative by permanent installation in the centrifugal compressor or in response to a control signal rendering operation of the plurality of flow stabilizing devices in a mode selected from the group consisting of simultaneously rendering the flow stabilizing devices operative and individually rendering the flow stabilizing devices operative. Rendering one or more flow stabilizing devices operative causes the shaped rod of each device to interact with flow discharging from the impeller in order to affect changes in the radial and tangential velocity components of the flow, thereby reducing the angle of the flow relative to a radial line and controlling the rate of diffusion with the diffuser. The magnitude of the interaction is varied by adjustments to the shape of the rod, depth of immersion of the rod into the diffuser, angle of the shaped surface relative to flow in the region of the diffuser where the device is employed, and adjustments to diffuser volume resulting from the position of the shaped structure relative to the diffuser end-wall. These type adjustments are meant to refer to only the shape variations and not other means to vary interaction.

In fluidic embodiments, the methods of invention provide a flow stabilizing device employing a single fluid jet or plurality of fluid jets that are made to interact in a continuous or intermittent fashion with flow in the region of the diffuser that is near the impeller discharge. Each of the flow stabilizing devices is rendered operative in response to a control signal rendering operation of the plurality of flow stabilizing devices in a mode selected from the group consisting of simultaneously rendering the flow stabilizing devices operative and individually rendering the flow stabilizing devices operative. Rendering one or more devices operative cause the fluid jet of each operative device to interact with flow discharging from the impeller in such a way that a substantial component of the velocity of the fluid jet is directly opposed to the tangential velocity component of the flow, thereby reducing the angle of the flow relative to a radial line and controlling the rate of diffusion with the diffuser. The magnitude of the interaction is varied by adjustments to the shape of the nozzle discharging the fluid jet, the orientation of the nozzle relative to flow in the region of the diffuser where the device is employed, and fluid pressure within the nozzle producing the fluid jet.

BRIEF DESCRIPTION OF THE DRAWINGS

FIG. 2 is composed of FIGS. 2A and 2B each of which shows a partial cross-section of the compressor of the present invention and, more particularly.

FIG. 3 is composed of FIGS. 3A and 3B that show the cross-section of the centrifugal compressor flow path of one embodiment of the present invention, wherein FIG. 3A shows an activated position of the flow stabilizing device of the present invention, and whereas

FIG. 4 is composed of FIGS. 4A, 4B, 4C, 4D, 4E and 4F, wherein

FIG. 7 is composed of FIGS. 7A, 7B, 7C, 7D, 7E and 7F, wherein

DETAILED DESCRIPTION OF THE PREFERRED EMBODIMENTS

Figure 1:
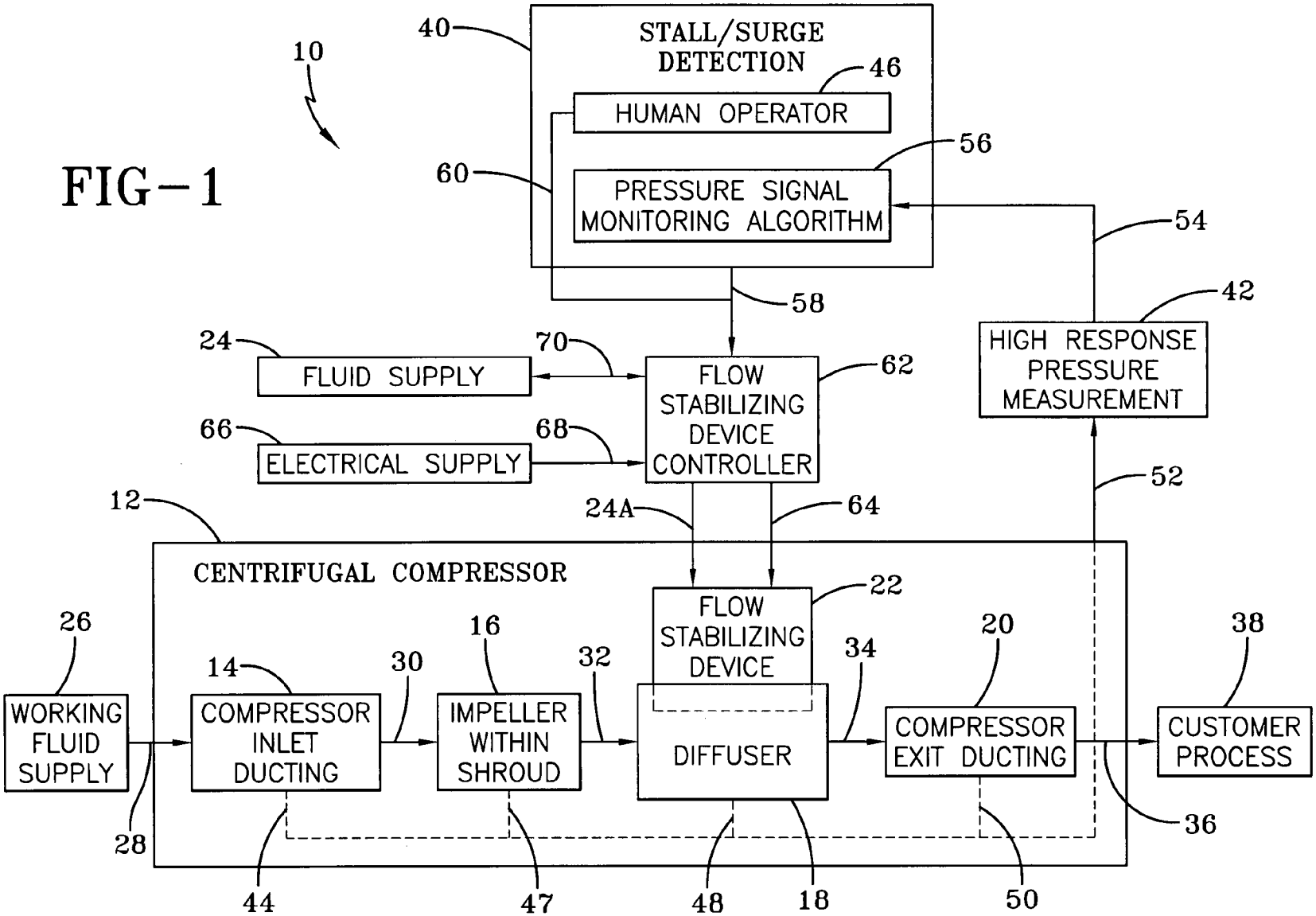
FIG. 1 is a block diagram of the system of the present invention particularly suited for centrifugal compressors.

Referring to the drawings wherein the same reference number is used to identify the same element throughout there is shown in FIG. 1 a block diagram of the system 10 of the present invention particularly suited for a centrifugal compressor 12.

The centrifugal compressor 12 comprises compressor inlet ducting 14, an impeller 16, which in one embodiment, to be further described hereinafter, is within a shroud, a diffuser 18, and compressor exit ducting 20. The centrifugal compressor 12 is operatively controlled by at least one flow stabilizing device 22, so as to prevent or eliminate flow instabilities of the compressor 12 that might otherwise cause rotating stall and surge conditions in the compressor 12 itself.

The flow stabilizing device 22 has various embodiments, such as 22A and 22B, that employ actuated or stationary rods. The flow stabilizing device has additional embodiments 22C, 22D, and 22E that utilize a fluid injection valve. Different embodiments of the flow stabilizing device 22, as to be further described hereinafter operatively cooperates with a fluid supply 24.

The impeller 16, to be further described hereinafter with reference to FIG. 2, has blades attached to a hub that rotate inside an enclosure that provides for providing a stationary flow path. As will be described hereinafter, if desired a shroud of the compressor 12 can provide a continuous internal surface for the flow path, but normally other elements of the compressor 12, such as internal ducting providing an internal hub surface, act in combination with the shroud to provide a stationary flow path. The impeller 16 receives a working fluid, via working fluid supply 26, path 28, compressor inlet ducting 14, and path 30 and imparts kinetic energy to the received working fluid and provides an output thereof that is in an orthogonal direction relative to the axis of rotation of the impeller 16. The output of the impeller 16 is routed, via path 32, to the diffuser 18 that operatively cooperates with at least one flow stabilizing device 22. Each of the flow stabilizing devices 22 receives the output of the impeller 16, and controls and modifies the flow direction, including the radial and tangential components of the velocity of the received output of the impeller 16. More particularly, each of the flow stabilizing devices 22 controls and modifies the flow direction of the received output of the impeller 16 over a portion of the diffuser 18 circumference that is greater than that portion that is occupied by the flow stabilizing device 22 itself. At least one flow stabilizing device 22 provides an output thereof that is directed to the diffuser 18 which provides an output, via path 34, to the compressor exit ducting 20 which, in turn, provides an output, via path 36, to the customer process 38, which may comprise a combustor of a turbine engine or devices used for industrial purposes.

The system 10 of the present invention preferably further includes a stall/surge detector 40. The stall/surge detector 40 is rendered operative by pressure signals from within the compressor 12 measured by sensing devices such as a single high-response pressure measurement device 42 utilizing at least one, but preferably a plurality of transducers 44, 47, 48 and 50 of a type commonly known in the art, such as the type manufactured by Kulite Semiconductor Products, Inc. The outputs of the plurality 44, 47, 48 and 50 of transducers are shown in FIG. 1 as being grouped in cable path 52 and as respectively interconnecting the high response pressure measurement device 42 to the outputs of the compressor inlet ducting 14, the impeller 16, the diffuser 18, and the compressor exit ducting 20. The output from the high response pressure measurement device 42 is inputted, via path 54, to a pressure signal monitoring device 56 comprised of a processing unit of the stall/surge detector 40 and that may be a PC or other device that is able to process the inputs, via algorithms or other means to detect rapid changes in pressure or in the pattern of pressure fluctuation within the compressor 12, and provide a representative output on path 58. Stall/surge detection 40 may also include detection by a human operator shown in FIG. 1 as human operator 46 and providing an appropriate output on path 60. Upon detection, the pressurized signal monitoring device 56 or human operator 46 provides respective signals routed to a flow stabilizing device controller 62.

The flow stabilizing device controller 62 is a conventional device, which may be comprised of switches and valves and has predetermined knowledge of which embodiment is being employed for the flow stabilizing device 22 and operates one or more flow stabilizing devices 22, via an output control signal supplied on path 64. The flow stabilizing device controller 62 receives fluid supply 24, via path 70 and supplies, via path 24A, the output of fluid supply 24 to the flow stabilizing device 22. The flow stabilizing device controller 62 receives electric supply via path 68 and supplies, via path 64, the output of electric supply 66 to the flow stabilizing device 22. The output paths 24A and 64 are compatible with the particular embodiment in use. In general, the output for mechanical embodiments provide controlled power fluid and/or electrical power, via paths 24A and 64, to operate motive devices to be further described hereinafter with reference to FIG. 4 that position the flow-field control rods of the flow stabilizing devices 22, within the diffuser 18. In general, the output for fluidic embodiments provides controlled fluid power, via path 24A, to produce the reverse tangent jet. In a stationary variant of the mechanical or fluidic embodiments, to be further described, device positioning is preset at the time of installation.

The impeller 16, known in the art, is typically in the form of a wheel carrying a plurality of blades or vanes, and mounted on an axis for rotation within a housing. Rotation of this impeller wheel causes gas (usually air), such as working fluid at input 30, to be drawn into the impeller wheel and to be discharged to a passage or passages for transferring the compressed gas to its destination, such as the customer process 38. In the case of a centrifugal compressor 12, the gas is discharged centrifugally.

The diffuser 18 is involved in transformation of part of the kinetic energy, supplied by impeller 16, of a moving fluid into pressure of the fluid, such as that at output 34. The diffuser 18 relies for its operation on the shape of the solid walls which confine the fluid flow, and does not involve the use of moving parts. Diffusers, such as diffuser 18, of this kind are used in many instances of great practical interest, for example, in the body of ejectors and at the outlet of centrifugal pumps, such as the output of the centrifugal compressor 12. It is generally found that the impeller 16, such as that of the centrifugal compressor 12, can efficiently deliver large amounts of kinetic energy to the pumped fluid, which then acquires a high velocity. The diffuser 18 transforms the kinetic energy into static pressure and supplies the output at path 36.

The centrifugal compressor 12 of the present invention is primarily associated with flow stabilizing devices 22 and methods of operation thereof for controlling the velocity and direction of the flow entering semi-vaneless and vaned passage regions of the diffuser 18 of the compressor 12, so as to prevent or even eliminate flow instabilities within the centrifugal compressor 12 that might otherwise cause related stall and surge conditions within the compressor 12 itself.

In one embodiment, the present invention provides flow stabilizing devices 22 comprised of flow-field control rods that reduce the threat of destructive flow instabilities (stall and surge conditions) that can otherwise develop in centrifugal compressors that are used in turbine engines and industrial processes. In another embodiment, flow stabilizing devices 22 comprised of a nozzle body provide a reverse-tangent injection of a working fluid into the vaneless regions of the diffuser 18 is provided. The injection of the stabilized fluid into the vaneless regions of the diffuser 18 is in the direction that is opposite to the direction of the prevailing flow within the diffuser 18. The injected fluid acts upon fluid that is discharged from the impeller 16 to reduce the tangential component of velocity in that fluid and, at the same time, to increase the radial velocity component of that fluid. This interaction helps prevent the flow instabilities that create the stall and surge conditions.

Figure 2A:
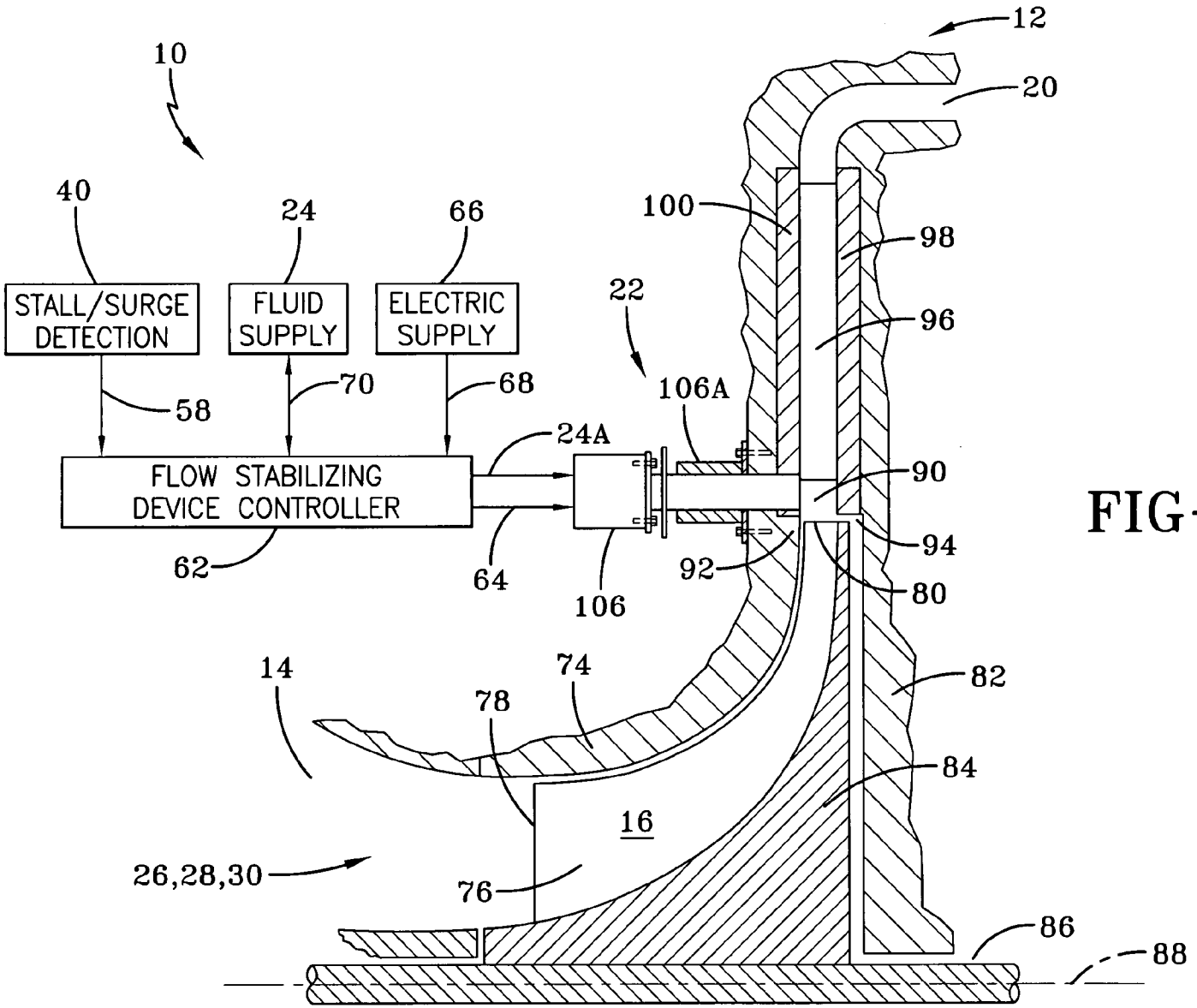
FIG. 2A shows the location of the flow stabilizing devices associated with the present invention being located on the shroud surface and FIG. 2B shows the location of the flow stabilizing devices associated with the present invention being located on the hub surface of the diffuser.
Figure 2B:
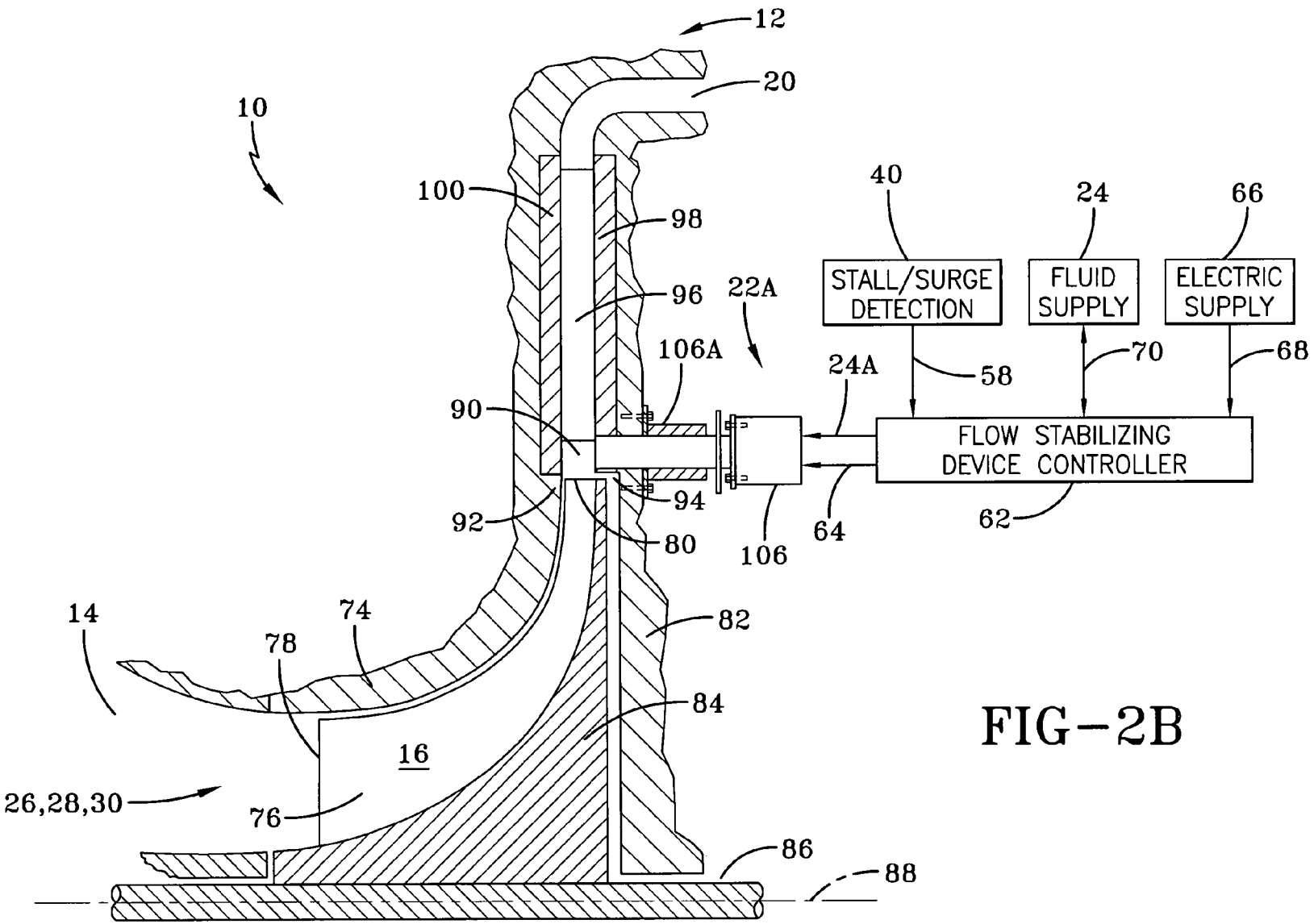

The flow stabilizing device controller 62 shown in FIG. 1, provides a control signal present on signal path 64 that is routed to the flow stabilizing device 22 as shown in FIG. 1. The interconnections of the flow stabilizing device controller 62, may be further described with reference to FIG. 2. FIGS. 2A and 2B each show a partial cross-section of the compressor of the present invention and, more particularly, FIG. 2A shows the location of the flow stabilizing device 22 associated with the present invention being located on the shroud surface of the diffuser, and FIG. 2B shows the location of the flow stabilizing device 22 associated with the present invention being located on the hub surface of the diffuser. The flow stabilizing device 22 has a coupling device 106, to be further described hereinafter with reference to FIG. 4, tailored to the embodiment in use, that receives the output of the controller 62, via path 64 and/or 24A. The paths 64 and 24A are conduits for transmission of either or both electrical and fluid power between the controller 62 and flow stabilizing device 22 permitting the flow stabilizing device 22 to be rendered operative in response to the output from the controller 62.

As seen in FIG. 2, the impeller 16 has a shroud 74, and at least one blade 76 having at one end a leading edge 78 positioned at the output 30 of the compressor inlet ducting 14 (shown in FIG. 1) and at the other end of the blade 76 is a trailing edge 80 (discharge). The impeller 16 further has a back plate 82, a hub 84, and a shaft 86 having a centerline 88.

As further seen in FIG. 2, the diffuser 18 has a vaneless region 90 positioned in coincidence with the output of the flow stabilizing device 22 in one embodiment at location 92 (see FIG. 2A) and in another embodiment at location 94 (see FIG. 2B) to be further described hereinafter. The diffuser 18 further has at least one vane 96, a diffuser hub end-wall 98, and a diffuser shroud end-wall 100. At least one of the vaneless regions 90 has an end-wall 98 or 100, to be further described hereinafter with reference to FIG. 12.

The centrifugal compressor 12 has a centrifugal impeller 16, which is comprised of a plurality of blades 76, attached to the hub 84 that rotates inside a stationary flow path typically formed by inlet 30, the shroud 74, the diffuser 18, and the compressor exit passage 20. The hub 84 is attached to the shaft 86 that supports the impeller 16 and transmits mechanical power to cause rotation of the impeller 16 within the shroud 74. FIG. 2A further illustrates one embodiment, wherein the flow stabilizing device 22 is located at 92 on the side of the shroud 74, whereas in another embodiment shown in FIG. 2B, the flow stabilizing device 22 may be placed at a location 94 on the surface of the diffuser hub end-wall 98. The centrifugal compressor 12 may be further described with reference to FIG. 3.

Figure 3A:
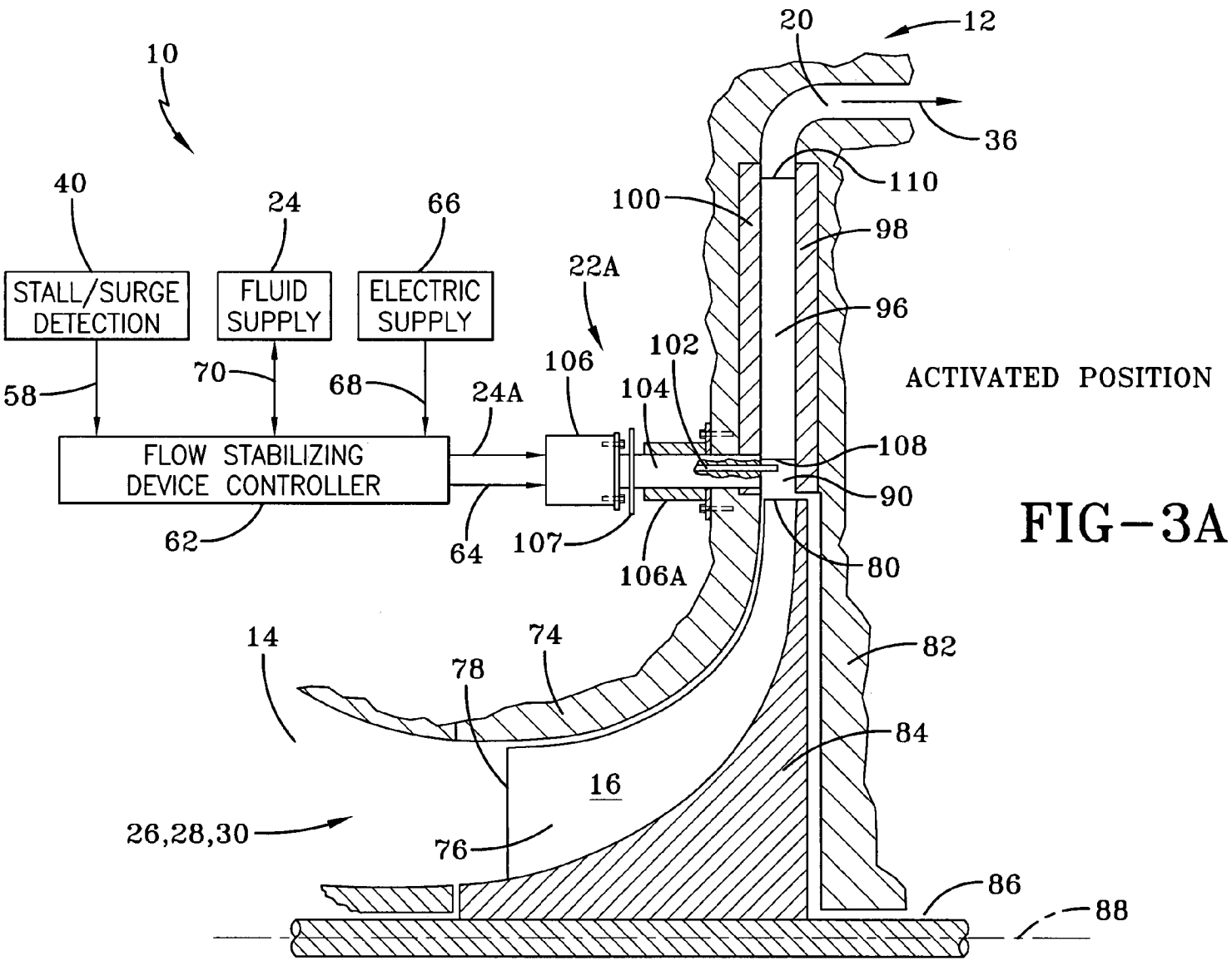
Figure 3B:
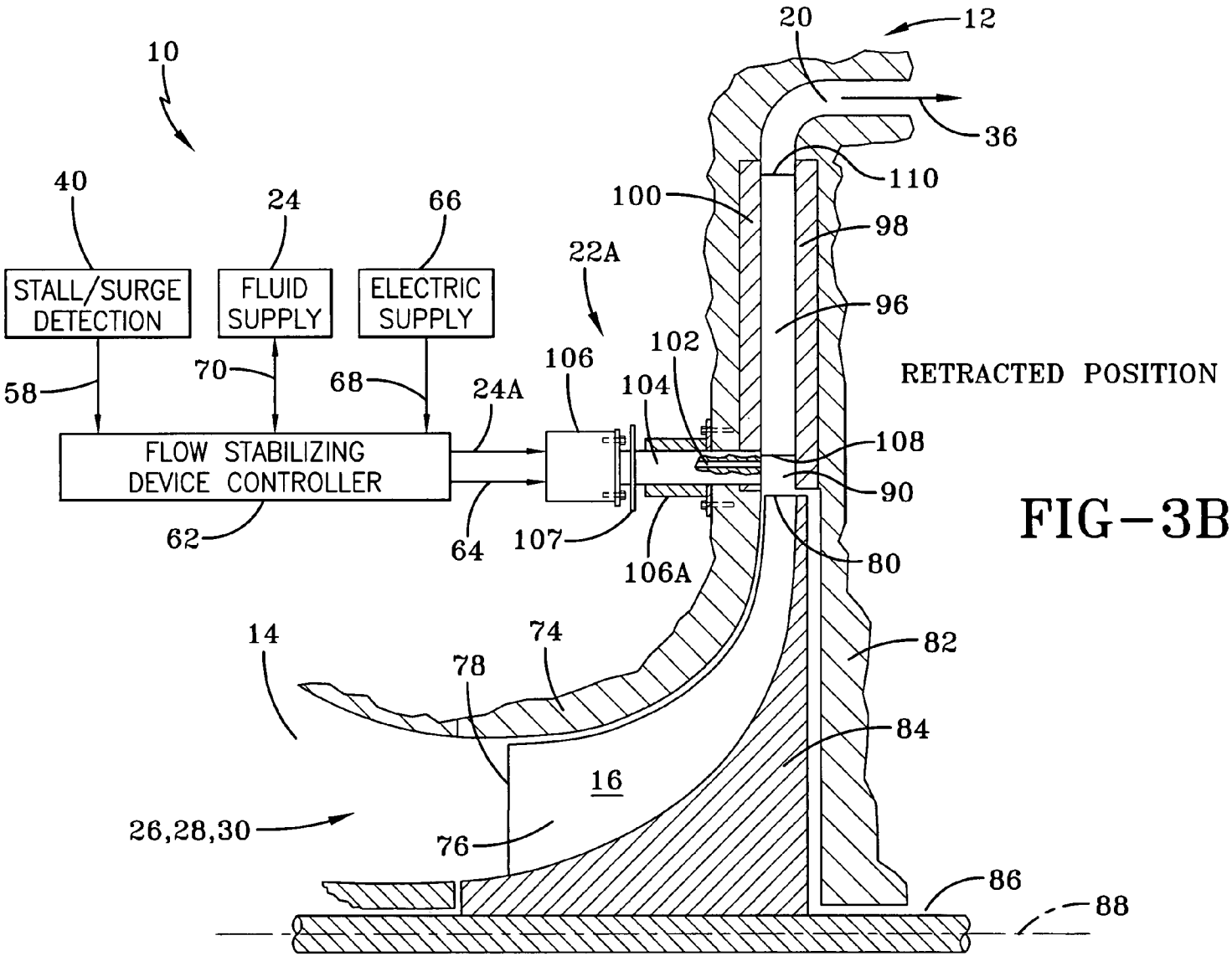
FIG. 3B shows the retracted position of flow stabilizing device of the present invention.

FIG. 3 is composed of FIGS. 3A and 3B that show a cross-section of the centrifugal compressor flow path, wherein FIG. 3A shows one embodiment 22A of the flow stabilizing device 22 in its activated position, and FIG. 3B shows the embodiment 22A of the flow stabilizing device 22 in its retracted position.

As seen in FIG. 3, a stream of gas from the working fluid supply 26, via inlet 30, enters the impeller 16, wherein blades 76 thereof act upon the flow to impart kinetic energy thereto. Flow exits the impeller 16 in a direction that is orthogonal or nearly orthogonal to the axis of rotation of the hub 84. The diffuser 18 accepts flow discharging from the impeller 16 and converts kinetic energy present in the flow to static pressure before discharging the pressurized flow to the compressor exit ducting 20. The diffuser 18, to be further discussed hereinafter with reference to FIG. 5, may be vane-island diffuser containing twenty-four passageways having a vaneless region 90 and a vane 96, shown in FIG. 3.

Figure 6:
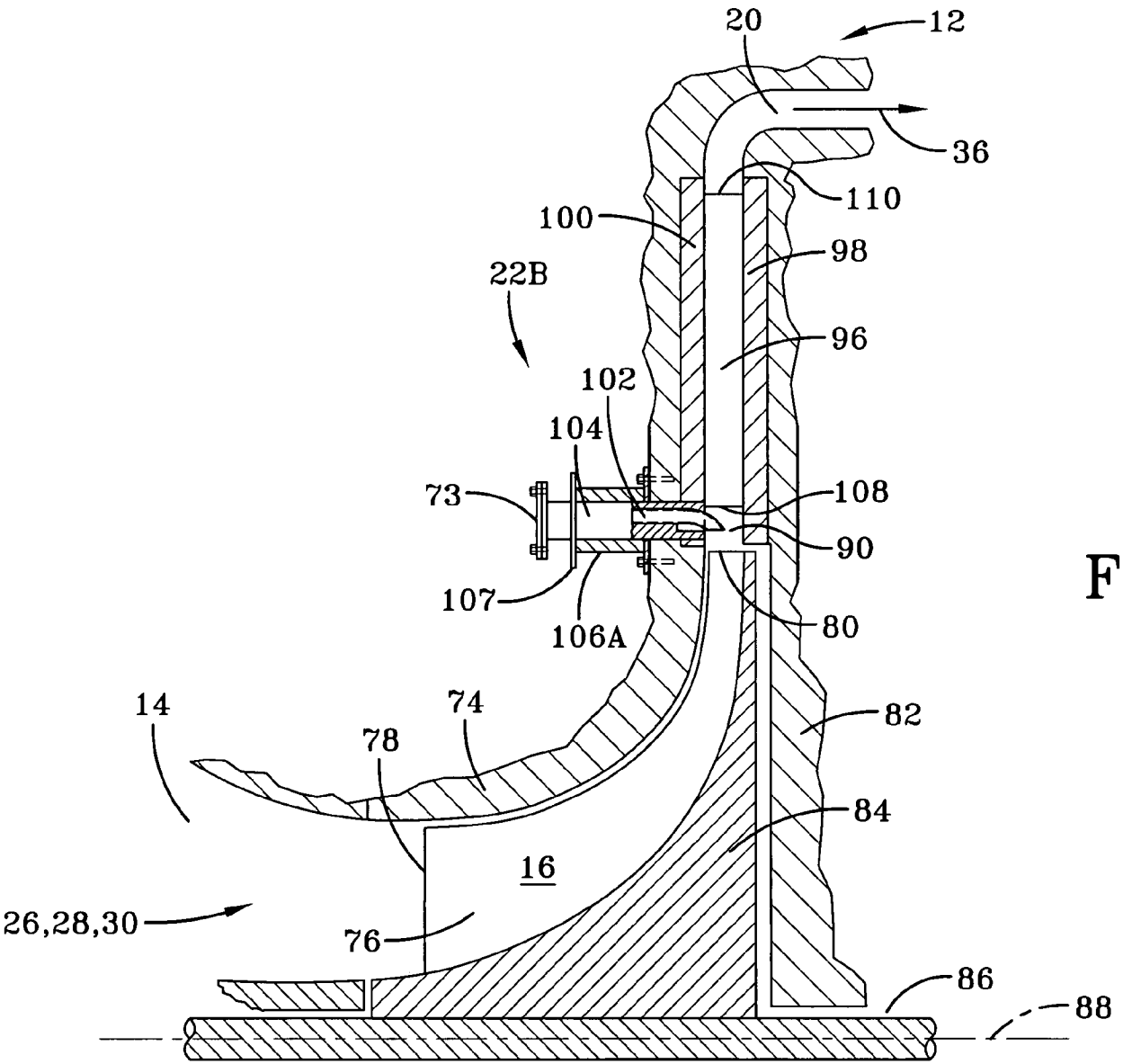
FIG. 6 is a cross-section of a centrifugal compressor flow path and the stationary flow stabilizing device of one embodiment of the present invention.
Figure 9B:
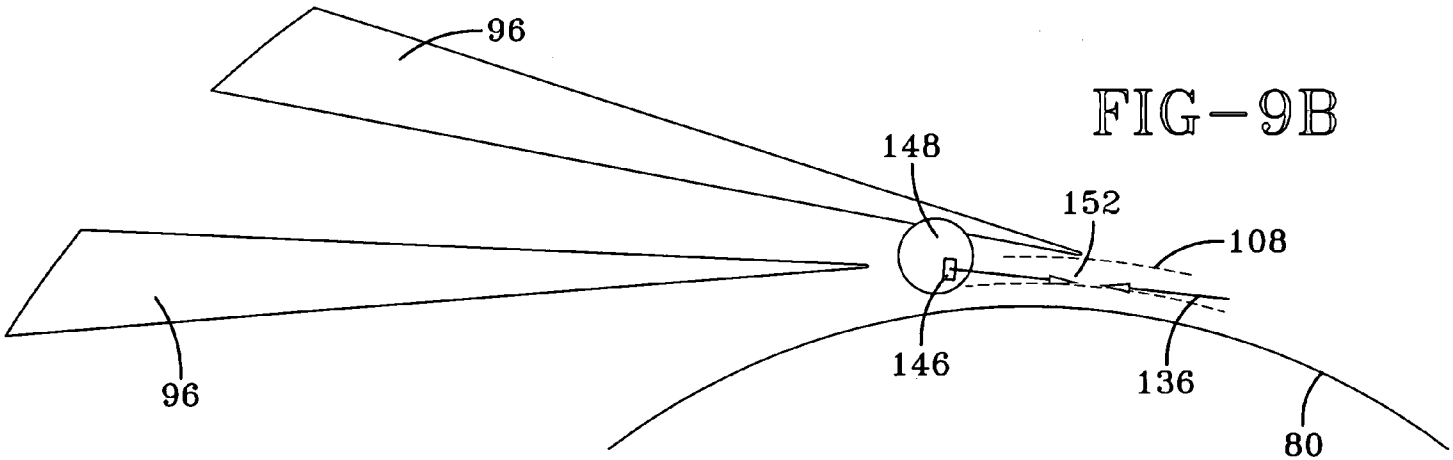
FIG. 9 is composed of FIGS. 9A, and 9B that respectively show the structure and operation related to one embodiment of the reverse-tangent injection device of FIG. 8 serving as a flow stabilizing device of the present invention.

As further seen in FIG. 3, the flow stabilizing device 22A, as well as flow stabilizing devices 22B to be described hereinafter with reference to FIG. 6, is comprised of a shaped rod 102 and guide sleeve 104 both contained in an actuator 106 and located adjacent to the impeller trailing edge 80 and the diffuser vaneless region 90. The flow stabilizing device 22A may be attached at location 92 or 94 by attachment structure 106A. Further, a nozzle body to be further described hereinafter with reference to FIGS. 9, 11 and 12, forms part of alternate embodiments 22C, 22D, and 22E.

Figure 4B:
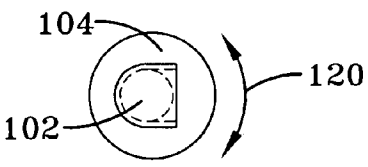
FIGS. 4A and 4B, 4C and 4D, and 4E and 4F show different views of alternative embodiments of the flow stabilizing device of FIG. 3.
Figure 4A:
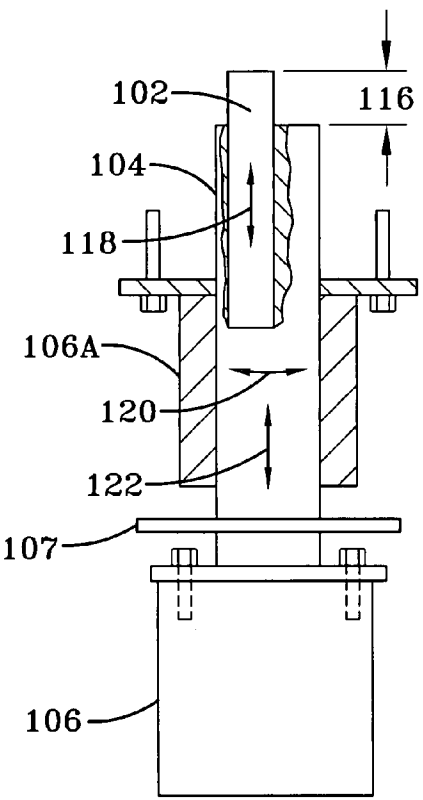
Figure 4D:
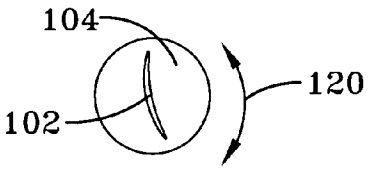
Figure 4C:
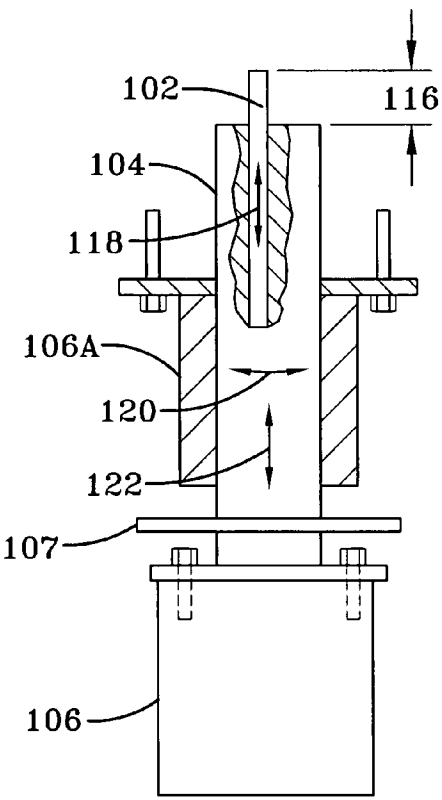
Figure 4F:
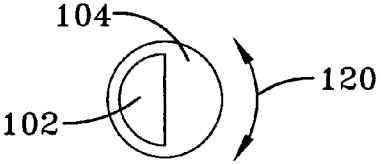
Figure 4E:
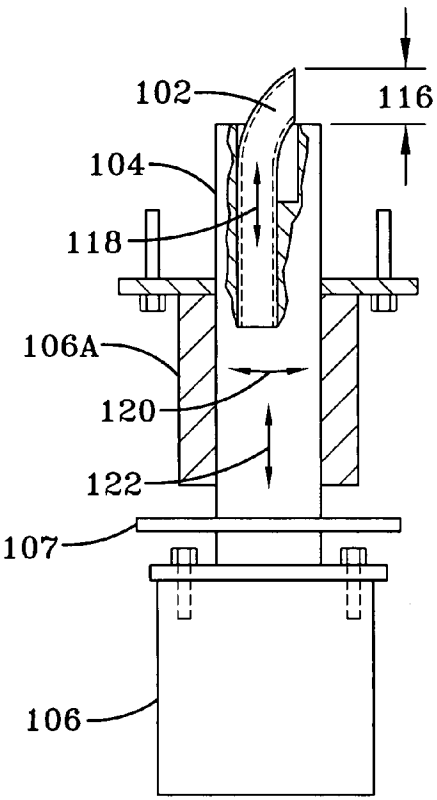

The vaneless region 90 of the channel diffuser 18 is bounded by a plane, to be further discussed hereinafter with reference to FIG. 5, by the trailing edge 80 and the leading edge radius 108 of vanes 96. The vanes 96 have a trailing edge radius 110. The diffuser 18, in operative cooperation with the impeller 16 and the flow stabilizing device 22A, accepts the air flow leaving the impeller 16, and provides an air flow output leaving compressor exit ducting 20 that eventually exits the compressor 12 at port 36. The flow stabilizing device 22A, may be further described with reference to FIG. 4 composed of FIGS. 4A, 4B, 4C, 4D, 4E and 4F, wherein FIGS. 4A and 4B illustrate the shaped rod 102 as having a semi-circle shape, FIGS. 4C and 4D illustrate the shaped rod 102 as comprising an airfoil, and FIGS. 4E and 4F illustrate the shaped rod as having a tubular shape. In FIG. 4, FIGS. 4A, 4C and 4E are side view broken away to show components, and FIGS. 4B, 4D and 4F are top views.

In all of the embodiments of FIG. 4, and with simultaneous reference to FIGS. 3A and 4, the flow stabilizing device 22A is activated by the activator 106 and the shaped rod 102 is emerged into the vaneless space 90 and guided therein by the guide sleeve 104. The actuator 106 has a shaft (not shown) connected to the shaped rod 102, wherein the shaped rod 102 is guided by the guide sleeve 104, so as to be moved past the guide sleeve 104 by the actuator 106 in response to the presence of a control signal generated by the flow stabilizing device controller 62 and appearing on signal path 64.

It is preferred that the actuator 106 for the moveable embodiments shown in FIG. 4 contain a motor, a piston or a solenoid that provides translation of the shaped rod 102 relative to the guide sleeve 104. The actuator 106 also preferably contains the fluid and electrical couplings needed by the particular embodiment that is being used.

As seen in FIG. 4, the shaped rod 102 receives translation 116, which corresponds to the directional arrow 118. Further, the shaped rod 102 receives rotation 120, from the guide sleeve 104, and also in correspondence with the rotational dimensional line 122 shown in FIGS. 4A, 4C and 4E. The guide sleeve 104 rotates with respect to the attachment structure 106A and receives rotation from a lever gear or disk 107 that is attached to, or is integral to, the guide sleeve 104 at a point that is outside of the attachment structure 106A. The force that is applied to lever, gear or disk 107 to cause rotation of the guide sleeve 104 may be applied by any one of a variety of motive devices such as the motor, piston and solenoid previously described, commonly used in the art, that is mounted to an attachment structure 106A or to an adjacent surface of the compressor 12. In a fixed embodiment, the guide sleeve 104 is manually rotated with respect to the attachment structure 106A before being secured to the attachment structure 106A at a selected orientation using threaded fasteners or other techniques commonly known in the art. The shaped rod 102 translates with respect to the guide sleeve 104, which translates with respect to the attachment structure 106A, which is affixed to the compressor 12. The final position of the shaped rod 102 within the diffuser vaneless space 90 is determined by the position of the shaped rod 102 relative to the guide sleeve 104 and the position of the guide sleeve 104 relative to the attachment structure 106A. The attachment structure 106A is grounded in the reference frame of compressor 12, which includes the vaneless space 90.

The application of force to the shaped rod 102, for the purpose of causing translation of the shaped rod 102 relative to the guide sleeve 104, may be accomplished by any one of a variety of motive devices, commonly used in the art, mounted to the guide sleeve 104. The application of force to the guide sleeve 104 for the purpose of causing translation of the guide sleeve 104 within the attachment structure 106A, may be accomplished by a motive device mounted to the attachment structure 106A.

In fixed embodiments, to be further described hereinafter with reference to FIG. 6, the position of the shaped rod 102 relative to the guide sleeve 104 may be set by a spacer shim (to be further described hereinafter with reference to FIG. 6) that may be trapped between exterior shoulders of the shaped rod 102 and guide sleeve 104 and secured to the adjacent objects 102 and 104 using threaded fasteners or other techniques commonly known in the art. Further, in a fixed embodiment, the position of the shaped rod 102 relative to the vaneless space 90 may be set by positioning the assembly comprised of the shaped rod 102 and guide sleeve 104 relative to the attachment structure 106A using a spacer shim trapped between exterior shoulders of the guide sleeve 104 and the attachment structure 106A and secured by threaded fasteners or other commonly known methods. The operation of all of the embodiments of FIG. 4 and that of FIG. 3, may be further described with reference to FIG. 5, which illustrates a centrifugal compressor vaned diffuser 18 and the locations of the flow stabilizing devices 22A relative to the impeller 16 and the channel diffuser 18.

Figure 5:
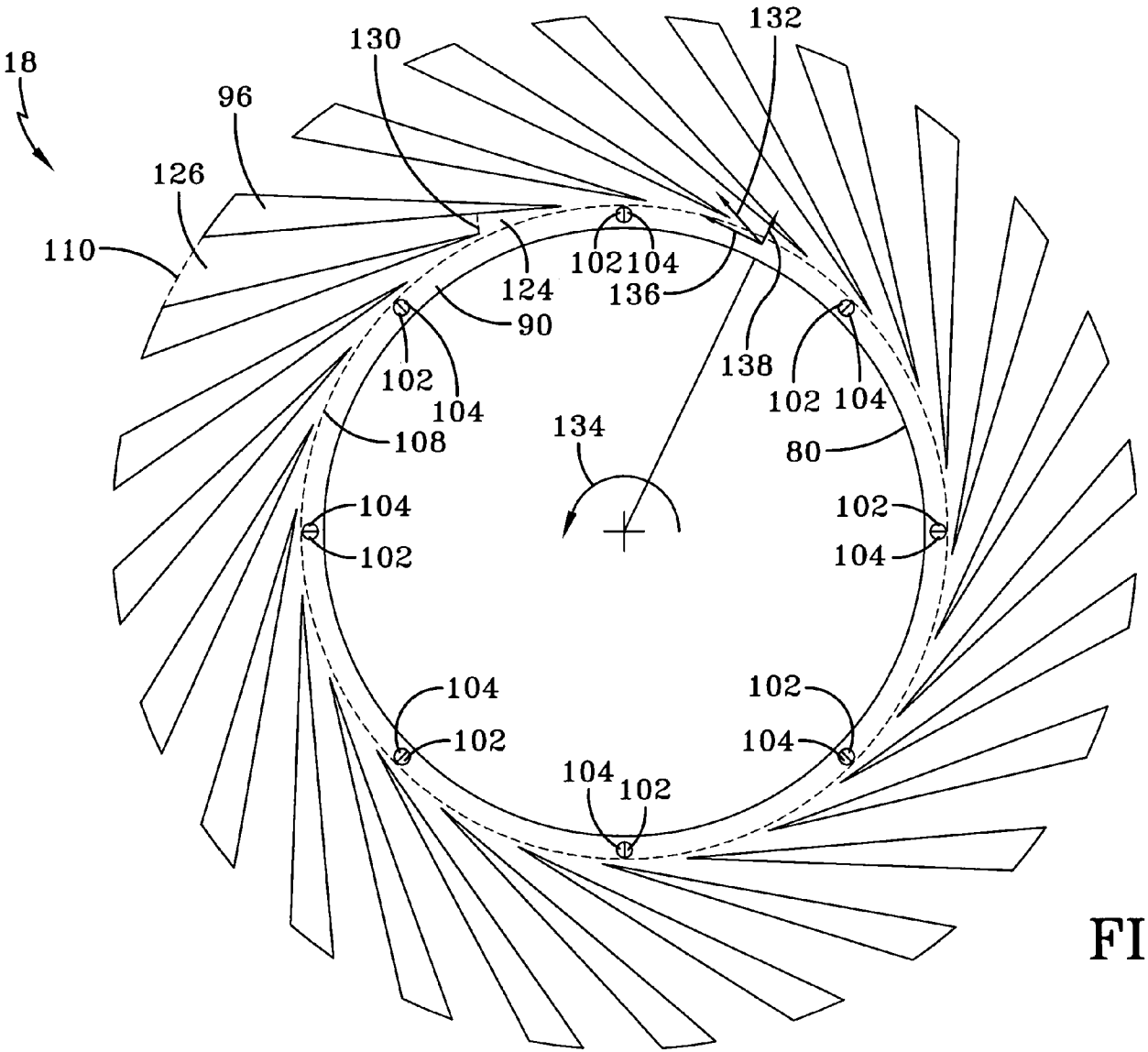
FIG. 5 illustrates the centrifugal compressor vaned diffuser of the present invention and the locations of the flow stabilizing devices of FIG. 3.

FIG. 5 is an elevation view of the channel diffuser 18 depicted in FIG. 3 looking in the forward to aft direction of the centrifugal compressor 12. Further, as previously mentioned, the vaneless region 90 is bounded in the plane of FIG. 5 by the impeller exit radius defined by the impeller trailing edge 80 and the diffuser leading edge radius 108 shown in phantom. Further, as seen in FIG. 5, the channel diffuser 18 has twenty-four (24) vanes 96 and twenty-four (24) passageways each identified by semi-vaneless region 124. Still further, as seen in FIG. 5, for one embodiment eight (8) flow stabilizing devices 22A, each identified by respective shaped rod 102 and guide sleeve 104, are spaced apart from each other about the circumference of the vaneless region 90.

As further seen in FIG. 5, the semi-vaneless regions 124 of the channel diffuser 18 are bounded by the leading edge radius 108 of vanes 96, by one surface from each of two adjacent vanes 96, and by the passage throat 130. The vaned passage 126 of the channel diffuser 18 is bounded by the passage throat 130, by one surface from each of two adjacent vanes 96, and by the trailing edge radius 110 of the vanes 96. FIG. 5 further illustrates the flow vector 132, also referred to herein as the absolute velocity vector, indicative of the flow of fluid entering and flowing within the diffuser 18, and the rotation 134 of the impeller 16. As seen in FIG. 5, the flow vector 132 is comprised of tangential and radial components 136 and 138.

The primary components of the flow stabilizing device 22A, utilizing flow-field control rods, are the shaped rod 102 and guide sleeve 104. The shaped rod 102 acts upon the flow-field, having the absolute velocity vector 132 shown in FIG. 5, in the diffuser vaneless region 90 between the impeller trailing edge 80 and the diffuser vane leading edge 108. One or more control rods, that is the shaped rods 102 and guide sleeves 104, can be installed on the impeller shroud side 74 (see FIG. 2A) of the diffuser 18 depending on the magnitude of the control requirement and on the space available for installation. The activated position of the shaped rod 102 (see FIG. 3A) within the diffuser 18 can be fixed or can translate (see FIG. 4, reference number 116) to a selectable immersion 116 (see FIGS. 3A and 4) and rotate (see FIG. 4 reference number 120) to a selectable orientation (see FIG. 4) when coupled to the actuating device 106 operated by the controller 62, shown in FIG. 3.

The absolute velocity of the flow vector 132 (see FIG. 5) traveling through regions 90 and 124 of the channel diffuser 18 is comprised of component vectors directed in the tangential and radial directions respectively shown in FIG. 5 by reference numbers 136 and 138. The shaped rod 102 causes the flow vector 132 to be turned toward a radial direction by changing the magnitudes of the tangential and radial components of the flow vector 132. As a result, diffusion levels in regions 90 and 124, pressure loading at the leading edge of vanes 96, and flow incidence at the leading edge of vanes 96 are all reduced, all contributing to preventing or eliminating flow instabilities that would otherwise create stall and surge conditions. Some rotating instability modes are eliminated in cases where the flow angle is reduced below a level that can support certain modes. In particular, a type of instability that can develop in centrifugal compressors is a backward traveling rotating stall waves, known in the art, as described by Spakovsky in the technical article entitled "*Backward Traveling Rotating Stall Waves in Centrifugal Compressor*", published in the Proceeding (Jun. 3-6 2002) of ASME Turbo Expo, Amsterdam, The Netherlands, ASME paper No. GT-2002-2039. The harmonic number of this disturbance will fall within a range that is determined by the characteristics of the centrifugal compressor 12 being utilized. Coupling criteria developed by Spakovsky indicate that the minimum harmonic number is dependent on the angle of the absolute velocity vector 132 compared to a radial line. The maximum harmonic of the disturbance is limited by the number of impeller blades 76. Applying these criteria, a reduction in the angle of the absolute velocity vector 132 will increase the minimum harmonic of the backward rotating disturbance. When the harmonic number has increased beyond the maximum that can be supported by impeller blade count the disturbance is eliminated.

The factors related to flow instabilities are reduced over the total circumference of the diffuser 18 by strategic placement of the shaped rod 102, along with guide sleeve 104 over a portion of the diffuser 18 circumference. A flow stabilizing device 22A comprised of elements 102 and 104, is shown at each of eight locations in FIG. 5 that are distributed about the circumference of the diffuser vaneless region 90. The number and distribution of the flow stabilizing devices 22A disposed about the diffuser 18 circumference can be tailored to match the expected stall/surge characteristics of a particular compressor and the space available for installation.

The actuator 106 of FIG. 4 can be of any type that will provide the level of control required by a user. The minimum actuator capability for an active configuration shown in FIG. 3A is bi-directional translation of the shaped rod 102 through the guide sleeve 104. A more sophisticated arrangement of actuator 106 and control systems will provide translation 116 of both the shaped rod 102 and guide sleeve 106 relative to each other and relative to the vaneless space 90. As previously mentioned, the translation and rotation of the shaped rod 102 relative to the guide sleeve 104 may be accommodated, in a manner known in the art, by the selection of the parameters of the shaft controlled by the actuator 106. Similarly, the translation of the guide sleeve 104 relative to the shaped rod 102 may also be accommodated, in a manner similarly to that previously described of the shaped rod 102 being translated relative to the guide sleeve 104. Further sophistication will provide a capability to continually adjust the orientation of the shaped rod 102, relative to flow within the vaneless space 90, via bi-directional rotation 122 of the guide sleeve 104. Still further, sophistication can be provided by various schemes to determine the optimum increments of translation and rotation using the motive devices, such as motors, pistons and solenoids previously described, and feedback control based on the flow stabilizing device 22A position and compressor performance. A further embodiment 22B on the fluid stabilizing device 22 may be further described with reference to FIG. 6, which is similar to FIG. 3 with the exception that FIG. 6 illustrates a stationary configuration, wherein the embodiment flow stabilizing device 22B, unlike embodiment 22A of FIG. 3, has no moving parts.

The stationary configuration 22B for the flow stabilizing device of FIG. 6 illustrates that the position of shaped rod 102 is fixed within the guide sleeve 104 which, in turn, is itself fixed to an attachment structure 106A. Unlike the moveable configuration 22A, the stationary configuration 22B is provided with a coupling device 73, which may be free of any interconnections to the flow stabilizing controller 62 of FIG. 1. If desired, the attachment structure 106A may be replaced by shims in a manner as previously described for the fixed embodiments. Immersion of the shaped rod 102 within the vaneless region 90 is preset by adjusting the position of shaped rod 102 relative to the guide sleeve 104. Orientation of the shaped rod 102 relative to the diffuser flow vector 132 may also be set by rotating the guide sleeve 104 about its horizontal axis in the plane of FIG. 6. Further details of the flow stabilizing device 22B may be further described with reference to FIG. 7.

Figure 7B:
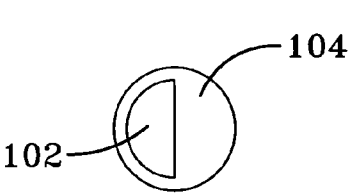
FIGS. 7A and 7B, 7C and 7D, and 7E and 7F show different views of alternative embodiments of the stationary flow stabilizing device of FIG. 6.
Figure 7A:
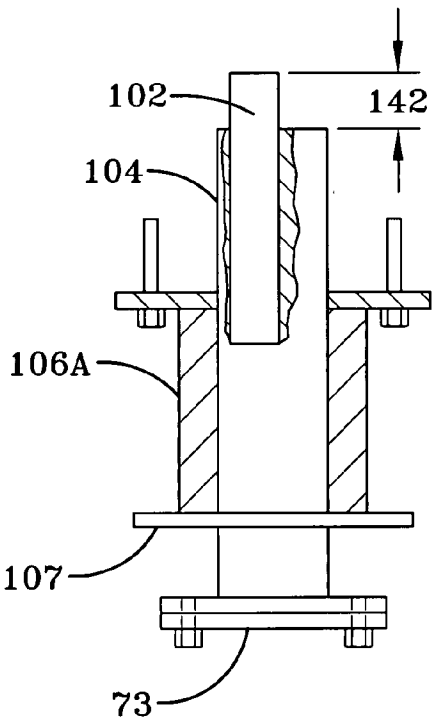
Figure 7D:
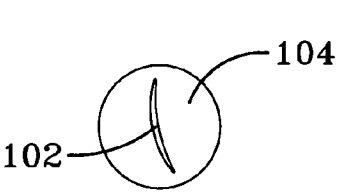
Figure 7C:
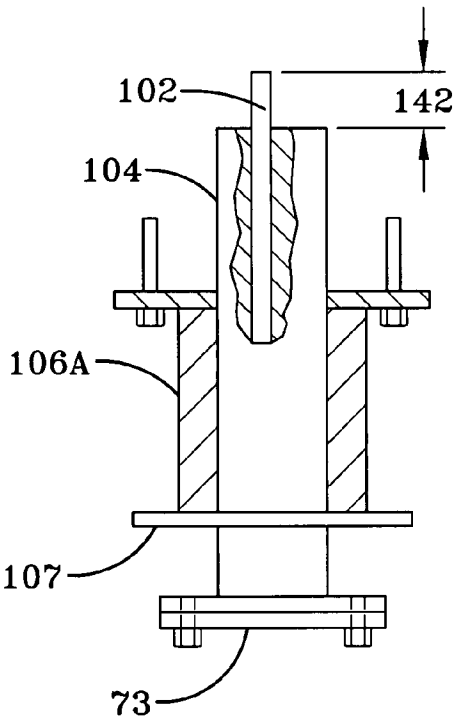
Figure 7F:
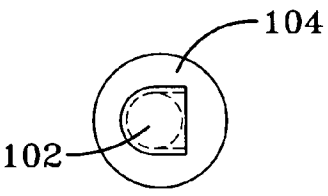
Figure 7E:
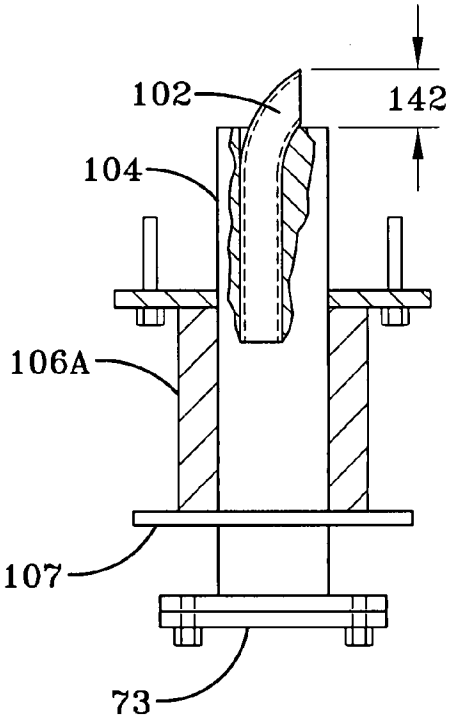

FIG. 7 is composed of FIGS. 7A, 7B, 7C, 7D, 7E and 7F whereas like the embodiments of FIGS. 4A, 4B, 4C, 4D, 4E and 4F respectively, FIGS. 7A and 7B illustrate the shaped rod 102 as having a semi-circle shape, FIGS. 7C and 7D illustrate the shaped rod 102 as being comprised of an airfoil, and FIGS. 7E and 7F illustrate the shaped rod 102 as having a tubular shape. Further, unlike that of FIG. 4, FIG. 7 illustrates the embodiments as having fixed immersion 142 and fixed orientation as shown in FIG. 7. The fixed immersion 142 and the fixed orientation operate in a manner as previously described for the translation 116 and rotation 122 of FIG. 4.

It should now be appreciated that the practice of the present invention provides for flow stabilizing devices in the form of flow-field control rods, that is, shaped rods 102 and/or guide sleeve 104, that reduce the threat of destructive instabilities (stall and surge) that can otherwise develop in centrifugal compressors used in turbine engines and industrial processes. The flow stabilizing devices 22A and 22B can be employed to prevent the stall and surge conditions in a centrifugal compressor and to stabilize the centrifugal compressor when stall and surge have already commenced. The flow stabilizing devices 22A and 22B operate through mechanical means and do not require internal or external air supplies, such as the pressurized fluid supply 24 of FIG. 1.

Figure 8A:
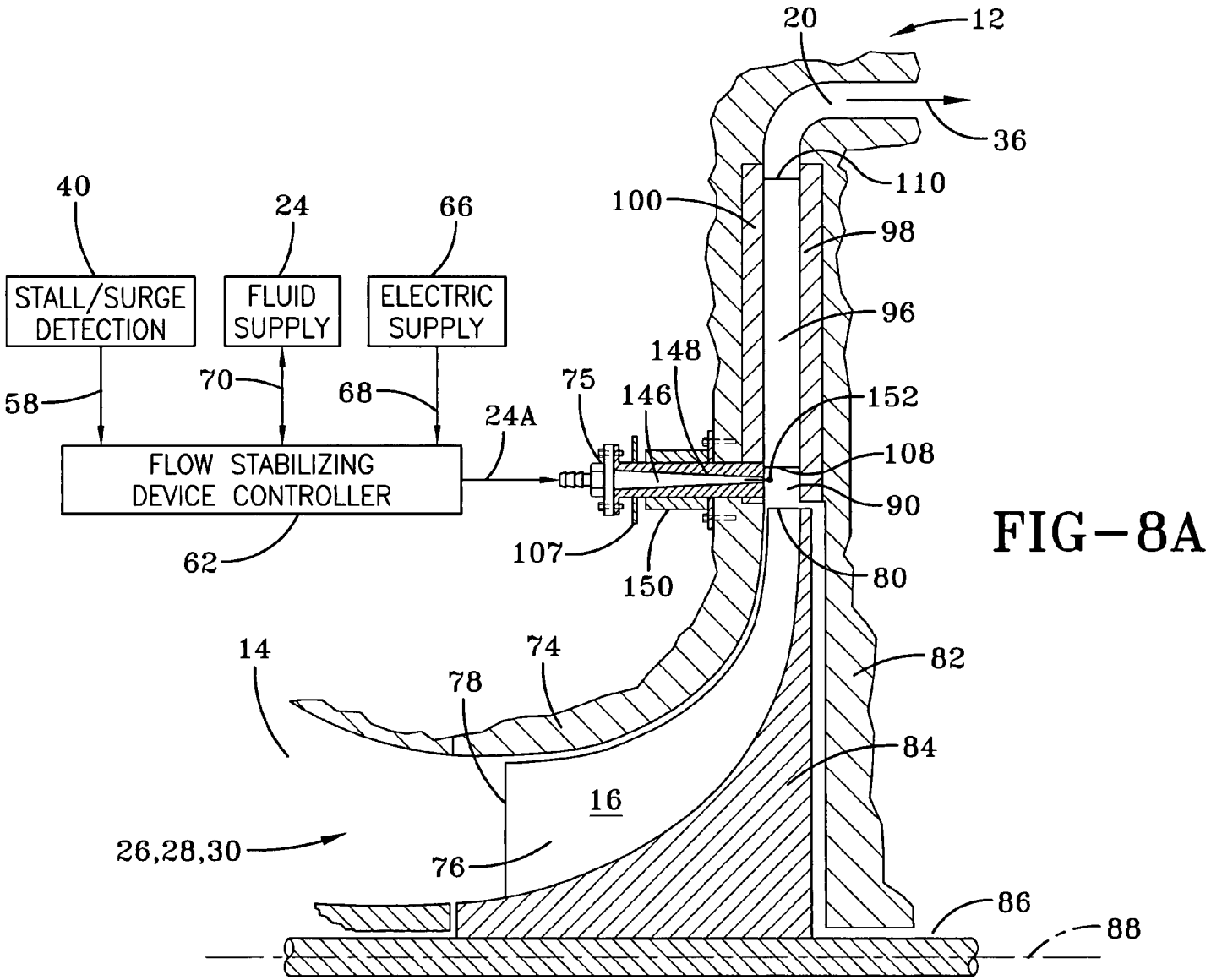
FIG. 8 is composed of FIGS. 8A and 8B that show the centrifugal compressor flow path each utilizing a reverse-tangent injection method, wherein a reverse-tangent injection method on the shroud surface of the diffuser is shown in FIG. 8A, and wherein a reverse-tangent injection method on the hub surface of the diffuser is shown in FIG. 8B.
Figure 8B:
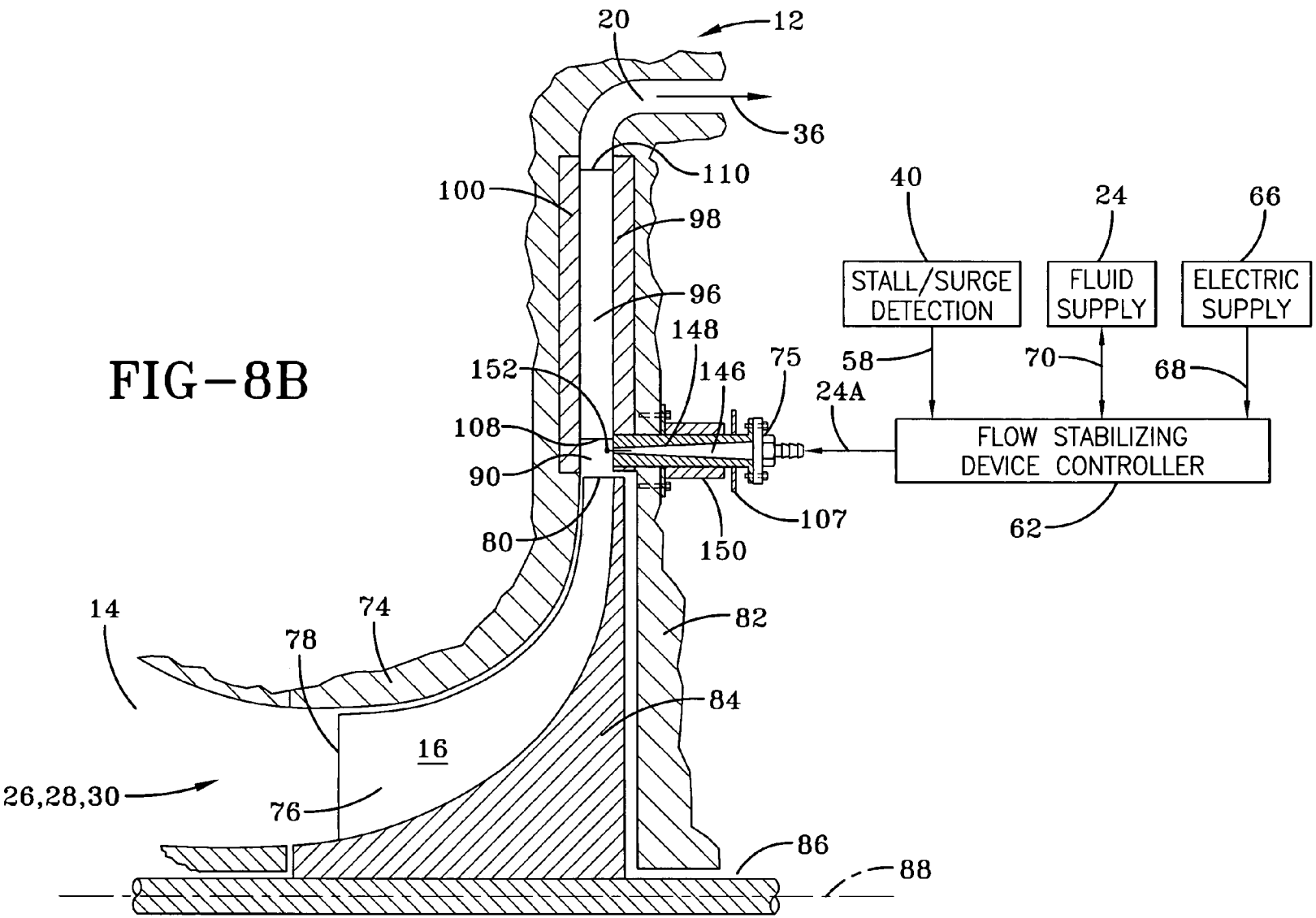

Further embodiments of the present invention may be further described with reference to FIG. 8, which is composed of FIGS. 8A and 8B that respectively illustrate a flow stabilizing device 22C, as being placed on the side of shroud 74 of the diffuser 18 and the side of hub 84 of the diffuser 18. The embodiment of FIG. 8 requires the interconnection of the pressurized fluid supply 24 having an output that is connected to the flow stabilizing device 22C, in particular, in one embodiment to coupling device 75. In a manner as previously mentioned, the flow stabilizing device controller 62 is responsive to the control signal on signal path 58 generated by the stall/surge detector 40 or by human operator 46, via signal path 60. The flow stabilizing device controller 62 in turn activates the pressurized fluid supply 24 by way of paths 70 and 24A.

The flow stabilizing device 22C comprises an internal passage 146 configured within a nozzle body 148 so as to provide a predetermined path. The internal passage 146 has an entrance arranged in correspondence with the output of the coupling device 75 and an exit leading into the enclosure, in particular, to the vaneless region 90 of the diffuser 18 as shown in FIG. 8. The flow stabilizing device 22C, further comprises an attachment structure 150 having provisions for mounting both the coupling device 75 and the nozzle body 148. One embodiment of the flow stabilizing device 22C may be further described with reference to FIG. 9, which is composed of FIGS. 9A and 9B that respectively show the structure of the flow stabilizing device 22C and the operational parameters of the flow stabilizing device 22C.

The flow stabilizing device 22C of FIG. 9 employs the nozzle body 148, preferably possessing a quasi-solid body, having the internal passage 146 that provides a flow path that directs a fluid-jet 152 in a direction that is tangent to the adjacent diffuser surface 100 (shroud) or 98 (hub) (see FIG. 2) and opposed to the tangential component of impeller 16 discharge flow 136 within the vaneless region 90.

Tangency to the surface 98 or 100 through which injection, flowing out of the exit of the internal passage 146 taking place is desirable. The internal passage 146 may be shaped to produce a jet 152 that stays attached to the end-wall surface adjacent to the injection point of the fluid control device 22C, in particular, the exit of the internal passage 146.

Figure 9A:
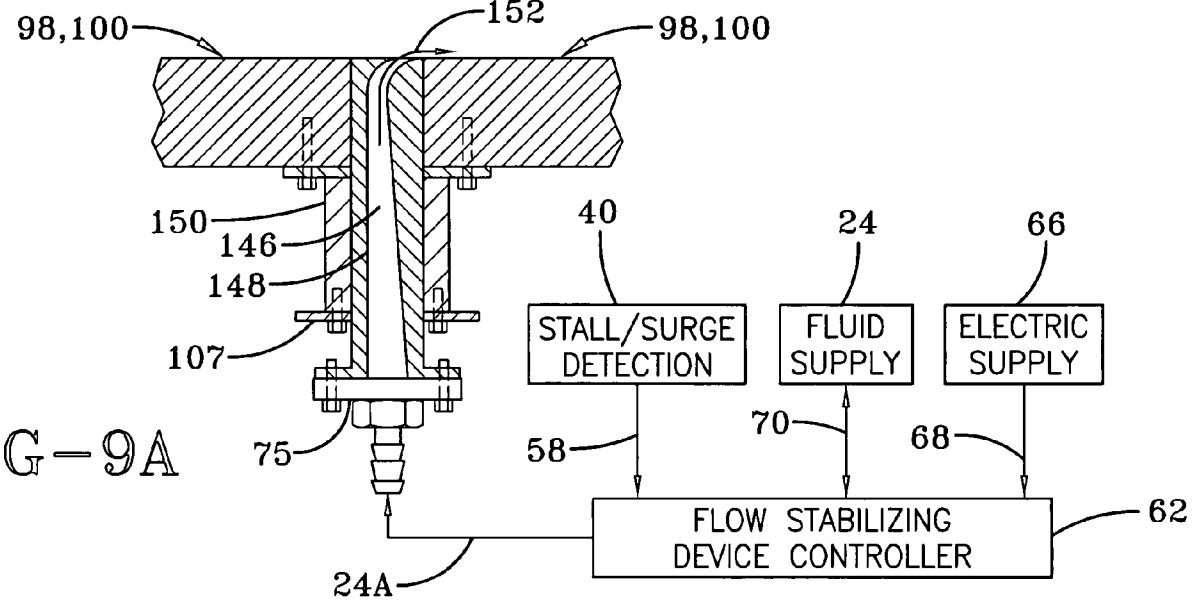

In the preferred embodiment of FIG. 9, the internal passage 146 is contained with a quasi-solid body 148 that is itself contained by an attachment structure 150. Injection fluid, making up jet 152, is supplied through the connector 75 that is connected to the flow stabilizing device controller 62, via the path 24A, as shown in FIG. 9A.

As most clearly seen in FIG. 9, reverse-tangent injection, provided by flow stabilizing device 22C, is a process wherein the stream 152 or jet 152 of working fluid, supplied from fluid supply 24, is injected into the vaneless space 90 of the centrifugal compressor 12 in a direction that is opposed to the tangential velocity component of impeller discharge flow 136 within the vaneless 90 region of the diffuser 18. The injected jet 152 acts upon fluid that is discharging from the impeller 16 so as to reduce the tangential component of velocity in that fluid and, at the same time, to increase the radial velocity component. Reverse-tangent injection may be implemented at one or several locations about the circumference of the diffuser vaneless space 90 as shown in FIG. 10.

Figure 10:
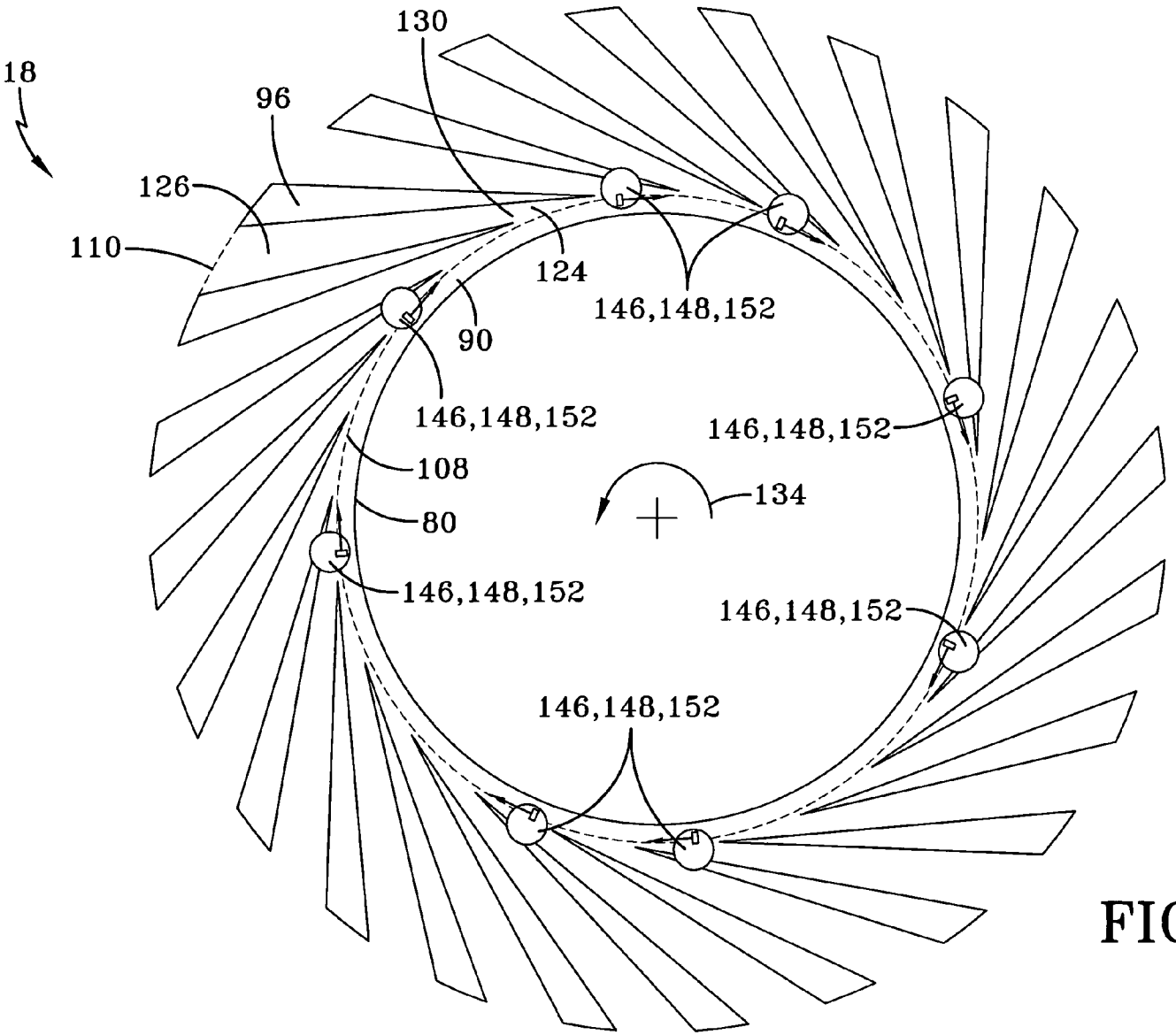
FIG. 10 illustrates the centrifugal compressor vaned diffuser associated with the embodiment of FIG. 8 and also showing the locations of the reverse-tangent injection devices utilized in FIG. 8 serving as a flow stabilizing device of the present invention.

FIG. 10 is quite similar to FIG. 5 with the exceptions that the flow stabilizing device 22A of FIG. 5 composed of the shaped rod 102 and guide sleeve 104 have been replaced by a showing in FIG. 10 of the internal passage 146 and nozzle body 148 and jet 152 (flow stabilizing device 22C).

The net effect of the reverse-tangent injection method shown in FIGS. 9 and 10 is to reduce the flow angle of fluid entering the semi-vaneless region 124 and the vaned passage 126, thereby reducing diffusion ahead of the passage throat 130 and incidence at the vane leading edge 108. Reduced flow angle also changes the dynamic coupling between the impeller 16 and diffuser 18 in such way as to prevent the previously discussed development of certain instability modes in the diffuser 18.

Figure 11B:
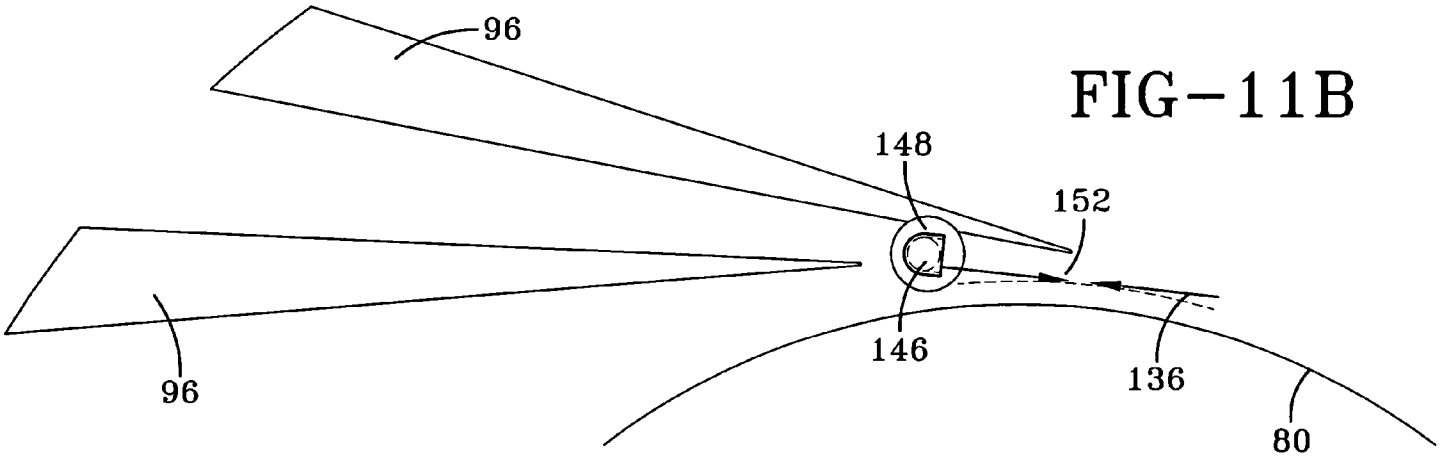
FIG. 11 is composed of FIGS. 11A and 11B that respectively show the structure and operation of an alternate embodiment of the reverse-tangent injection device utilized in FIG. 8 serving as a flow stabilizing device of the present invention.
Figure 11A:
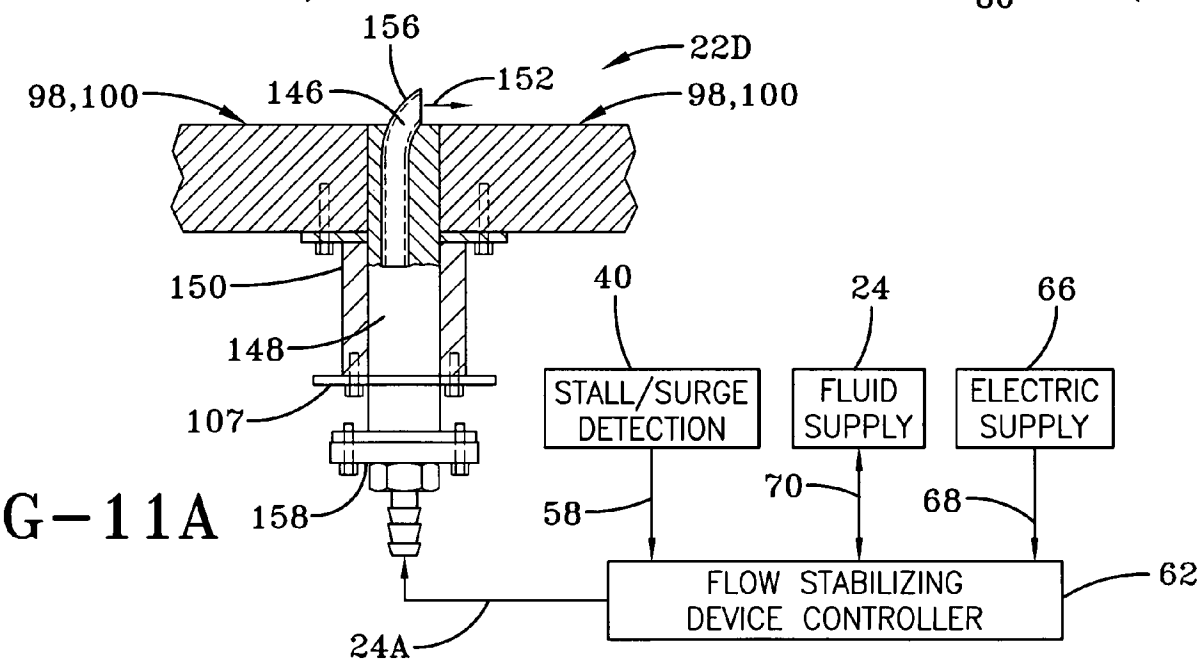

A further embodiment 22D of a flow stabilizing device that provides for a reverse-tangent injection of fluid may be further described with reference to FIG. 11 composed of FIGS. 11A and 11B and respectively showing the structure of the embodiment 22D and the operational parameters of embodiment 22D. The embodiment 22D of the flow stabilizing device also utilizes the fluid supply 24, which is responsive to the control signal generated by the flow stabilizing device controller 62 and presented on signal path 24A. The flow stabilizing device 22D, having a tip 156, which is part of coupling device 158, is connected to the output of the fluid supply 24, as shown in FIG. 11A. The coupling device 158 is arranged to a predetermined path that extends outward from a nozzle body 148, which is located at the shroud surface 74 (see FIGS. 2 and 8A) or the hub surface 84 (see FIGS. 2 and 8B). The nozzle body 148 has an internal passage configured to conform to predetermined path of the coupling device 158 and also configured to accommodate the coupling device 158. The nozzle body 148 is mounted to the attachment structure 150. The tip 156 of the coupling device 158 is partially emerged into the vaneless space 90. The coupling device 158 injects a stream 152 or jet 152 of working fluid, previously discussed with reference to FIG. 9, into the vaneless space 90 that aligns with the adjacent surface and is opposed to the tangential component of the discharge flow 136 of the impeller 16.

Figure 12B:
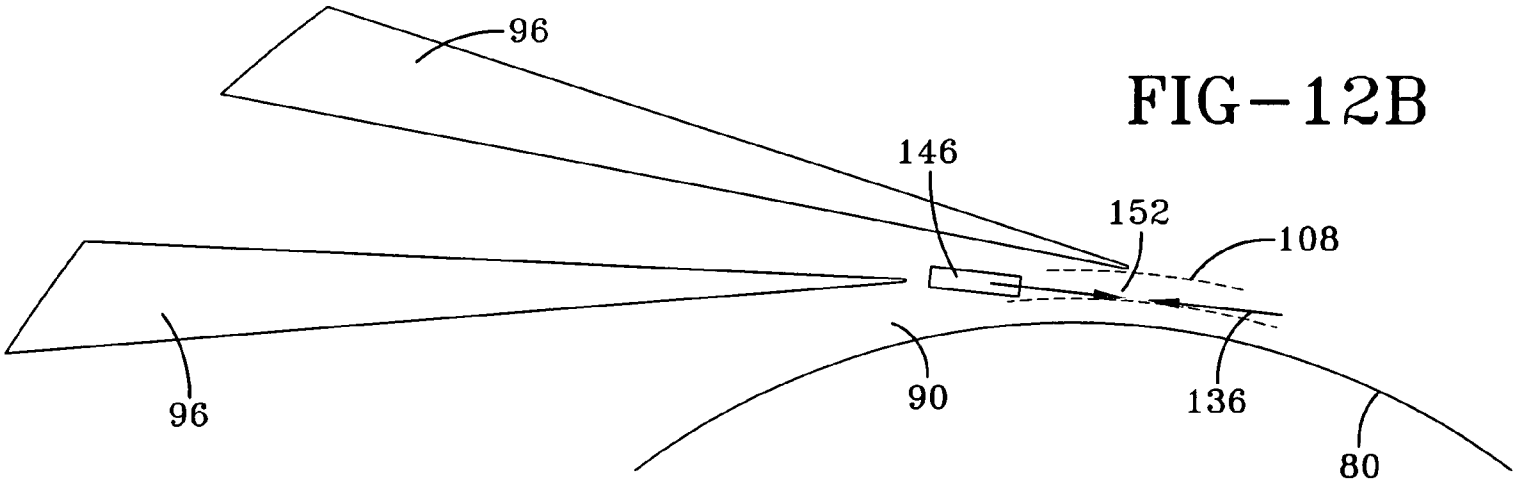
FIG. 12 is composed of FIGS. 12A and 12B that respectively illustrate the structure and operation of another alternate embodiment of the reverse-tangent injection device utilized in FIG. 8 serving as a flow stabilizing device of the present invention.
Figure 12A:
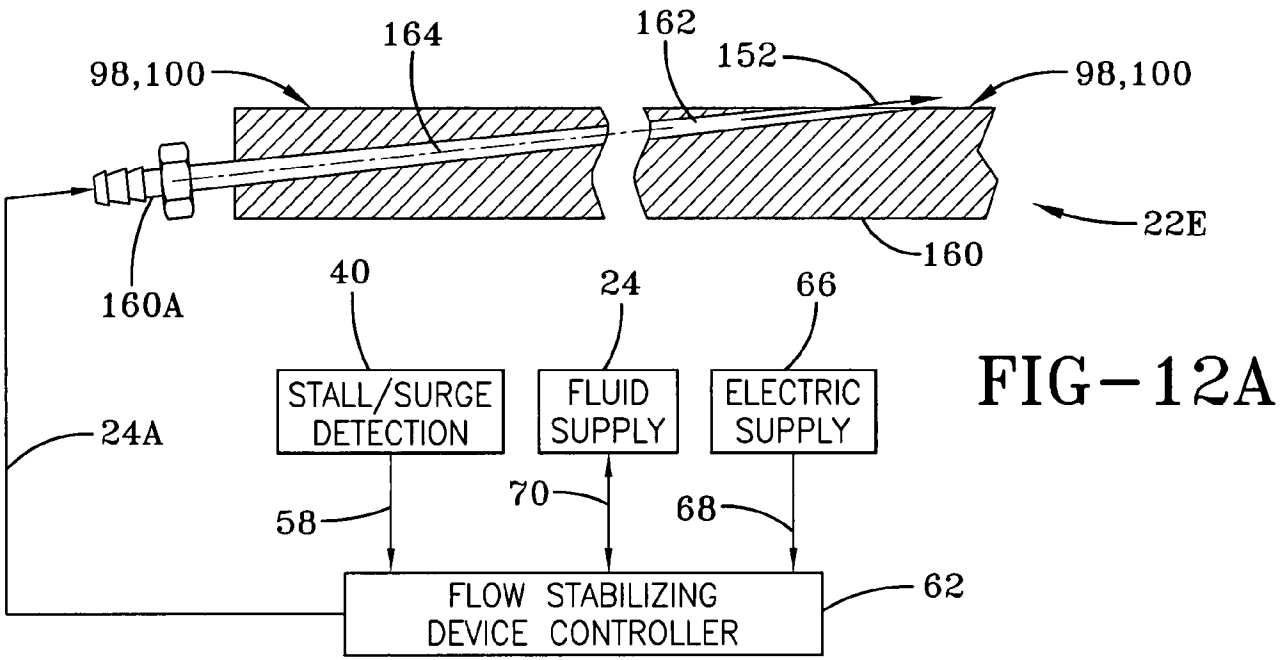

A further embodiment of the present invention may be further described with reference to FIG. 12, which illustrates an embodiment 22E of the flow stabilizing device 22, wherein FIG. 12A illustrates the structure of the embodiment 22E and FIG. 12B illustrates the operating parameters of the embodiment 12E. The embodiment of 22E of the flow stabilizing device comprises a structure 160 with a connector 160A and having a passageway 162, in particular, a channel 162 that carries the fluid 152 to the injection point on the diffuser hub (98) or shroud end-wall surface 100 (see FIG. 2). The channel 162 has a center line 164. The angle of the center line of the channel 162 is preferably kept relatively small so that the angle of the injected jet 152 relative to the vaneless space surface is also small, so as to produce a jet 152 that is nearly tangent to the adjacent surface 98 or 100 having an injection point. The predetermined path that is passageway 162, as well as the predetermined paths of the other embodiments and the injection point of adjacent surface 98 or 100, is selected so that the fluid steam 152, acts upon fluid flow within the diffuser 18, so as to reduce diffusion between the impeller trailing edge 80 and the diffuser passage throat 130, within a segment of the diffuser circumference that is greater than the segment occupied by the injection point.

The channel 162 may originate at a point that is external to the compressor 12 where injection fluid is supplied. More particularly, the channel 162 may originate at the fluid supply 24 that supplies the jet 152. The embodiment 22E of FIG. 11 operates in a manner similar to embodiments 22D of FIG. 11 and 22C of FIG. 9.

It should now be appreciated that the practice of the present invention provides for various embodiments, all of which yield reverse-tangent injection of the working fluid into the vaneless regions 90 of the channel diffuser 18 of a centrifugal compressor 12 that reduces the threat of destructive fluid instabilities manifested in stall and surge conditions of the centrifugal compressor 10.

Operation of the Fluid Control Devices of the Invention

The flow stabilizing devices 22A, 22C, 22D, and 22*e* may be employed in three functional operating modes. The first is a continuous operation, wherein the flow stabilizing devices of FIG. 22*a*, 22*c*, 22*d*, or 22*e* may be emerged and oriented in a predetermined manner and is set prior to the centrifugal compressor 12 operation and remains stationary. The invention may also provide an open-loop operation with a number, where the number of the flow stabilizing devices, such as flow stabilizing device 22A of FIG. 3, the immersion and orientation angle (see FIG. 3A) are predetermined and set by an on-off activation, motivated by controller 62 which, in turn, is motivated by stall/surge detector 40, when the compressor and stability or conditions known to cause flow instabilities are detected by the stall/surge detector 40 and then fully retracted (see FIG. 3B) when stable compressor operation returns. The invention also provides a closed loop or feedback control operation where the compressor stability is monitored by the stall/surge detector 40 and the number of active flow stabilizing devices, flow stabilizing device immersion, and flow stabilizing device orientation, are continuously adjusted using a dynamic control model that controls the actuator 106.

It should now be appreciated that the practice of the present invention provides for various embodiments and methods of operation thereof that reduce, or even eliminate, the stalling surge and stall conditions that may otherwise occur the centrifugal compressors.

The invention has been described with reference to preferred embodiments and alternates thereof. It is believed that many modifications and alterations to the embodiments as discussed herein will readily suggest themselves to those skilled in the art upon reading and understanding the detailed description of the invention. It is intended to include all such modifications and alterations insofar as they come within the scope of the present invention.

The above and other novel features and advantages of the invention, including various novel details of the construction and combination of parts will now be more particularly described with reference to the accompanying drawings and pointed out by the claims. It will be understood that the particular devices embodied in the invention are shown and described herein by way of illustration only, and not as limitations of the invention. The principles and features of the invention may be employed in numerous embodiments without departing from the scope of the invention in its broadest aspects.

We claim:

1. A centrifugal compressor comprising:

a) an impeller comprised of a plurality of blades attached to a hub and rotating inside an enclosure that provides for a stationary flow path, said impeller receiving an input fluid and imparting kinetic energy to the received fluid having an absolute velocity and providing an output from said impeller that is in an orthogonal direction relative to the axis of rotation of said impeller;

b) at least one flow stabilizing device interacting with the output of the impeller and modifying the tangential and radial components of the absolute velocity vector of the received fluid flow output of the impeller; said at least one flow stabilizing device providing an output, said flow stabilizing device being responsive to a control signal generated by a controller providing motive power for the purpose of activating and deactivating said flow stabilizing device, and;

c) a diffuser receiving said output of the flow stabilizing device and providing a pressurized fluid output, said diffuser being a vane-island diffuser containing a predetermined number of passageways and comprising vaneless, semi-vaneless and vaned-passage regions, said flow stabilizing device comprises a rod, having at one end a shaped surface arranged to abut the vaneless and semi-vaneless regions of said diffuser, said rod having its opposite end connected to an actuating device and arranged to provide translation of said rod relative to a guide sleeve, said rod and said actuating device being supported by said guide sleeve which at one end abuts the vaneless and semi-vaneless regions of said diffuser, said guide sleeve being supported by an attachment structure and coupled to said actuating device that provides translation and rotation of said guide sleeve relative to said attachment structure in response to said output of said controller.

2. The centrifugal compressor according to claim 1, wherein said diffuser has a passage throat and wherein said shaped rod is moveable outward past said guide sleeve so as to act upon fluid flow within said vaneless and semi-vaneless regions of said diffuser so as to reduce diffusion ahead of said diffuser passage throat.

3. The centrifugal compressor according to claim 1, wherein said diffuser has a passage throat and wherein said guide sleeve is moveable relative to a surface adjacent said vaneless regions so as to provide a variation in flow area surrounding said shaped rod in order to modify the action of said rod upon fluid flow within said vaneless and semi-vaneless regions of said diffuser.

4. The centrifugal compressor according to claim 1, wherein said diffuser has at least one vane having a leading edge and wherein said shaped rod is moved outward past said guide sleeve so as to act upon the fluid flow within the vaneless and semi-vaneless regions of the diffuser and so as to reduce flow angle and incidence angle of flow at the vane leading edge.

5. The centrifugal compressor according to claim 4, wherein said impeller has a geometry that supports a known number of maximum harmonics each representative of a backward traveling rotating stall wave disturbance and wherein said reduction in flow angle renders a harmonic number that is greater than said number of maximum harmonics.

6. The centrifugal compressor according to claim 1, wherein said diffuser has at least one vane having a leading edge and having a passage throat, wherein said shaped rod is moveable outward past said guide sleeve so as to act upon the fluid flow within the vaneless and semi-vaneless regions of the diffuser so as to reduce pressure loading at the leading edge of the vane.

7. The centrifugal compressor according to claim 1, wherein said shaped rod is shaped so as to act upon and control the fluid flow present within said diffuser.

8. The centrifugal compressor according to claim 1, wherein said shaped rod is selected to have dimensions that can be scaled to match the dimensions of said vaneless and semi-vaneless regions in said diffuser.

9. The centrifugal compressor according to claim 1, wherein said shaped rod is moveable outward past said guide sleeve so that it can translate to various immersions within the vaneless and semi-vaneless regions in said diffuser.

10. The centrifugal compressor according to claim 1, wherein said actuator has further provisions so that said shaped rod is translated relative to said guide sleeve and moved past said guide sleeve by said actuator in response to the presence of said control signal generated by said controller.

11. The centrifugal compressor according to claim 10, wherein said shaped rod can be rotated, via rotation of said guide sleeve, to various orientations relative to the fluid flow within the vaneless and semi-vaneless regions of said diffuser.

12. The centrifugal compressor according to claim 1, wherein said shaped rod is selected to have a shape selected from the group consisting of a semi-circle, an airfoil and a tube.

13. The centrifugal compressor according to claim 1, wherein an orientation of said guide sleeve is selected from the group consisting of fixed and variable orientations relative to said fluid flow in said vaneless and semi-vaneless regions of said diffuser.

14. A centrifugal compressor comprising:

a) an impeller comprised of a plurality of blades attached to a hub and rotating inside an enclosure that provides for a stationary flow path, said impeller receiving an input fluid and imparting kinetic energy to the received fluid having an absolute velocity and providing an output from said impeller that is in an orthogonal direction relative to the axis of rotation of said impeller;

b) at least one flow stabilizing device interacting with the output of the impeller and modifying the tangential and radial components of the absolute velocity vector of the received fluid flow output of the impeller; said at least one flow stabilizing device providing an output, said flow stabilizing device being responsive to a control signal generated by a controller providing motive power for the purpose of activating and deactivating said flow stabilizing device, and;

c) a diffuser receiving said output of the flow stabilizing device and providing a pressurized fluid output, said diffuser being a vane-island diffuser containing a predetermined number of passageways and comprising vaneless, semi-vaneless and vaned-passage regions, said flow stabilizing device comprising a nozzle body having at one end an integral passageway arranged to abut against said vaneless and said semi-vaneless regions of said diffuser, said flow stabilizing device having a connection to said controller at its opposite end, said flow stabilizing device being supported by an attachment structure and coupled to an actuating device that provide translation and rotation of said nozzle body relative to said attachment structure in response to said output of said controller.

15. The centrifugal compressor according to claim 14, wherein said diffuser has a circumference and has a passage throat and said impeller has a trailing edge and, wherein an injection point occupies a segment of said circumference of said diffuser, and wherein a predetermined path and said injection point are selected so that a fluid stream acts upon fluid flow within the diffuser so as to reduce diffusion between the impeller trailing edge and the diffuser passage throat within a segment of the diffuser circumference that is greater than the segment occupied by said injection point.

16. The centrifugal compressor according to claim 14, wherein said diffuser has a circumference and has vanes each having a leading edge and, wherein an injection point occupies a segment of said circumference of said diffuser and wherein a predetermined path and said injection point are selected so that a fluid stream acts upon fluid flow within the diffuser so as to reduce pressure loading on the leading edge of the diffuser vanes within a segment of the diffuser circumference that is greater than the segment occupied by said injection point.

17. The centrifugal compressor according to claim 14, wherein said diffuser has a circumference and has a radial line and wherein the fluid within said diffuser is a process fluid having an absolute flow angle and wherein said internal passageway has an injection point which occupies a segment of said circumference of said diffuser and wherein a predetermined path is selected so that a fluid stream acts upon fluid flow within said diffuser so as to reduce the flow angle of said process fluid within the diffuser relative to a radial line within a segment of the diffuser circumference that is greater than the segment occupied by said injection point.

18. The centrifugal compressor according to claim 17, wherein said impeller has a geometry that supports a known number of maximum harmonics each representative of a backward traveling rotating stall wave disturbance and wherein said reduction in flow angle is of sufficient magnitude to produce a flow angle that renders a harmonic number that is greater than said number of maximum harmonics.

19. The centrifugal compressor according to claim 17, wherein said diffuser has a circumference and has vanes each with a leading edge and wherein said predetermined path is selected so that said fluid stream acts upon the process fluid flow within the diffuser so as to reduce the flow angle incidence between the process fluid flow and the leading edge of the diffuser vanes within a segment of the diffuser circumference that is greater than the segment occupied by said injection point.

20. The centrifugal compressor according to claim 17, wherein said centrifugal compressor has a shroud with a surface facing said diffuser and said hub has a surface facing said diffuser and wherein said injection point is arranged to a location selected from the group consisting of said shroud surface of said diffuser and said hub surface of said diffuser.

* * * * *